United States Patent [19]

Abe et al.

[11] Patent Number: 4,775,612

[45] Date of Patent: Oct. 4, 1988

[54] PROCESSING OF SILVER HALIDE COLOR PHOTOGRAPHIC MATERIAL WITH BISAMINOALKYLARYLENE COMPOUNDS

[75] Inventors: Akira Abe; Jun Arakawa; Yasushi Nozawa, all of Kanagawa, Japan

[73] Assignee: Fuji Photo Film Co., Ltd., Kanagawa, Japan

[21] Appl. No.: 938,919

[22] Filed: Dec. 8, 1986

[30] Foreign Application Priority Data

Dec. 9, 1985 [JP] Japan ..... 60-276624

[51] Int. Cl.[4] ..... G03C 5/24; G03C 5/38; G03C 7/00; G03C 7/32

[52] U.S. Cl. ..... 430/375; 430/393; 430/398; 430/428; 430/429; 430/430; 430/432; 430/460; 430/463; 430/490

[58] Field of Search ..... 430/528, 460, 463, 393, 430/398, 430, 490, 428, 429, 432, 375

[56] References Cited

U.S. PATENT DOCUMENTS

| | | | |
|---|---|---|---|
| 3,093,479 | 6/1963 | Olivares et al. | 430/428 |
| 4,336,324 | 6/1982 | Koboshi et al. | 430/421 |
| 4,362,812 | 12/1982 | Minamizono et al. | 430/528 |
| 4,552,834 | 11/1985 | Lau et al. | 430/430 X |

*Primary Examiner*—Mukund J. Shah

*Attorney, Agent, or Firm*—Sughrue, Mion, Zinn, Macpeak, and Seas

[57] ABSTRACT

A method for processing a silver halide color photographic material is disclosed, wherein a washing bath is replenished with water in an amount of from 2 to 50 times the volume of the preceding bath which is carried over with the photographic material into the washing bath per unit area of the photographic material to be processed, and washing in the washing bath is carried out in the presence of at least one compound represented by formula (I):

$$A\text{-}(X)_l\text{-}(R^3)_m\text{-}\underset{(H)_p}{\overset{R^1}{N}}\text{-}R^2)_n(Y)_q \qquad (I)$$

wherein A represents a n-valent aliphatic, aromatic or heterocyclic linking group, wherein when n is 1, A represents a monovalent aliphatic, aromatic, or heterocyclic group, or a hydrogen atom; X represents —O—, —S—, or $$-\overset{R^4}{\overset{|}{N}}-;$$

$R^1$ and $R^2$ each represents substituted or unsubstituted lower alkyl group; $R^3$ represents a lower alkylene group; $R^4$ represents a lower alkyl group; or $R^1$ and $R^2$, $R^1$ and A, $R^1$ and $R^3$, $R^2$ and A, or $R^2$ and $R^3$ may be connected to each other to form a ring; Y represents an anion; l represents 0 or 1; m represents 0 or 1; n represents 1, 2, or 3; p represents 0 or 1; and q represents 0, 1, 2, or 3, and is a value which renders the molecule electrically neutral. The processing method can achieve a great saving of water for washing while protecting the processed color photographic material from mold, the formation of stains, and undergoing accelerated discoloration.

16 Claims, No Drawings

PROCESSING OF SILVER HALIDE COLOR PHOTOGRAPHIC MATERIAL WITH BISAMINOALKYLARYLENE COMPOUNDS

FIELD OF THE INVENTION

This invention relates to processing of a silver halide color photographic light-sensitive material (hereinafter referred to more briefly as color light-sensitive material). More particularly, it relates to a method of processing which can achieve great reduction of water for washing and yet still protects the processed color light-sensitive material from mold, formation of stains, and undergoing discoloration.

BACKGROUND OF THE INVENTION

In the field of processing of silver halide photographic materials, studies have been directed to reducing the amount of water used in washing processing, etc., from the standpoint of environmental conservation, water resources, and costs incurred. For example, it has been proposed to reduce the amount of water by using a washing tank in multiple stages and producing a countercurrent of water as disclosed in S. R. Goldwasser, "Water Flow Rates in Immersion-Washing of Motion Picture Film", *Journal of the Society of Motion Picture and Television Engineers,* Vol. 64, pp. 248–253 (May, 1955). Further U.S. Pat. No. 4,336,324 describes a system in which photographic materials are subjected to stabilization immediately after bleach-fix without involving substantial washing to thereby save water.

These conventional methods are currently applied to various automatic developing machines as an effective means for water saving.

However, reduction of the amount of water for washing has been found to create another problem, in that the processed light-sensitive materials are apt to remarkably become moldy during preservation due to increased amounts of various processing solution components remaining in the processed light-sensitive materials, a part of which acts as a nutrient source for mold. It has also been found that reduction in wash water causes insufficient removal of sensitizing dye from the light-sensitive materials, thereby increase stains on the processed materials, and ultimately resulting in serious impairment of photographic performance properties.

Of the above-described problems, generation of mold has been a problem even when washing water is not saved. In this connection, *Photographic Science and Engineering,* Vol. 3, p. 132 (1959) describes that pentachlorophenol is an effective antifungal agent, to be added, usually, to a stabilizing bath after washing. However, this compound is of no practical use nowadays due to its extremely high toxicity. Further, ammonium-releasing compounds have been described to be effective antifungal agents also applicable to the cases where washing water is saved, as disclosed in Japanese Patent Application (OPI) No. 135942/85 (the term "OPI" as used herein means "unexamined published application"). These compounds, however, are still insufficient in mold-proofing performance, and, moreover, sometimes cause more discoloration of color light-sensitive materials depending on the kind of dyes used.

With respect to the problem of increase of stains due to sensitizing dyes remaining unwashed, a satisfactory remedy has yet to be found.

Therefore, it has been strongly desired to develop a method of processing which does not involve the above-described problems even if washing water is greatly reduced.

SUMMARY OF THE INVENTION

One object of this invention is to provide a method for processing a color light-sensitive material which achieves a great saving of washing water.

Another object of this invention is to provide a method for processing a color light-sensitive material which achieves a great saving of washing water without generation of mold on processed color light-sensitive materials.

A further object of this invention is to provide a method for processing a color light-sensitive material which achieves a great saving of washing water without the occurrence of mold on processed color light-sensitive materials or increased discoloration.

A still further object of this invention is to provide a method for processing a color light-sensitive material which achieves a great saving of washing water without an increase of stains on processed materials.

A yet further object of this invention is to provide a method for processing a color light-sensitive material which can impart excellent mildew resistance to the color light-sensitive materials.

The above objects can be accomplished by a method for processing a silver halide color photographic material, in which a washing bath is replenished with water in an amount of from 2 to 50 times the volume of the preceding bath which is carried over with the light-sensitive material into the washing bath per unit area of the light-sensitive material to be processed and washing in the washing bath is carried out in the presence of at least one compound represented by formula (I) hereinafter described.

Formula (I) is represented by

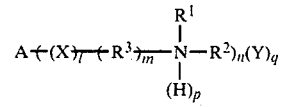

(I)

wherein A represents an n-valent aliphatic, aromatic or heterocyclic linking group (when n is 1, A represents a monovalent aliphatic, aromatic or heterocyclic group, or a hydrogen atom); X represents —O—, —S—, or

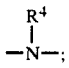

$R^1$ and $R^2$ each represents a substituted or unsubstituted lower alkyl group; $R^3$ represents a lower alkylene group; $R^4$ represents a lower alkyl group; $R^1$ and $R^2$, $R^1$ and A, $R^1$ and $R^3$, $R^2$ and A, or $R^2$ and $R^3$ may be connected to each other to form a ring; Y represents an anion; l represents 0 or 1; m represents 0 or 1; n represents 1, 2, or 3; p represents 0 or 1; and q represents 0, 1, 2, or 3, and is a value which renders the molecule electrically neutral.

DETAILED DESCRIPTION OF THE INVENTION

The linking group as represented by A includes an aliphatic linking group, such as an alkylene group having from 3 to 12 carbon atoms (e.g., trimethylene, hexamethylene, cyclohexylene, etc.); an aromatic linking group, such as an arylene group having from 6 to 18 carbon atoms (e.g., phenylene, naphthylene, etc.); and a heterocyclic linking group, such as a heterocyclic group containing at least one hetero atom (e.g., an oxygen atom, a sulfur atom, a nitrogen atom, etc.), (e.g., thiophene, furan, triazine, pyridine, piperidine, etc.).

The aliphatic, aromatic, or heterocyclic linking group, usually comprising one group, may be composed of two or more groups which may be connected either directly or via a divalent linking group, e.g., —O—, —S—, $$-\overset{\overset{R^5}{|}}{N}-,$$

$—SO_2—$, —CO—, or a combination thereof, wherein $R^5$ represents a lower alkyl group.

The aliphatic, aromatic or heterocyclic linking group may be substituted with, for example, an alkoxy group, a halogen atom, an alkyl group, a hydroxyl group, a carboxyl group, a sulfo group, a sulfonamido group, a sulfamoyl group, etc.

The lower alkyl group as represented by $R^4$ includes a methyl group, an ethyl group, etc.

The unsubstituted alkyl group as represented by $R^1$ or $R^2$ includes a methyl group, an ethyl group, a propyl group, an isopropyl group, a pentyl group, etc. The substituent for the substituted alkyl group for $R^1$ or $R^2$ preferably includes a hydroxyl group, a lower alkoxy group (e.g., a methoxy group, a methoxyethoxy group, a hydroxyethoxy group, etc.), an amino group (e.g., an unsubstituted amino group, a dimethylamino group, an N-hydroxyethyl-N-methylamino group, etc.), and the like. The two or more substituents may be the same or different.

$R^3$ represents a lower alkylene group having from 1 to 5 carbon atoms, e.g., a methylene group, an ethylene group, a trimethylene group, a methylmethylene group, etc.

The anion as represented by Y includes a halide ion (e.g., a chlorine ion, a bromine ion, etc.), a nitrate ion, a sulfate ion, a p-toluenesulfonate ion, an oxalate ion, etc.

$R^1$ and $R^2$ may be connected to each other via a carbon atom or a hetero atom (e.g., an oxygen atom, a nitrogen atom, a sulfur atom, etc.) to form a 5- or 6-membered hetero ring (e.g., a pyrrolidine ring, a piperidine ring, a morpholine ring, a triazine ring, an imidazoline ring, etc.).

$R^1$ (or $R^2$) and A may be linked together via a carbon atom or a hetero atom (e.g., an oxygen atom, a nitrogen atom, a sulfur atom, etc.) to form a 5- or 6-membered hetero ring (e.g., a hydroxyquinoline ring, a hydroxindole ring, an isoindoline ring, etc.).

$R^1$ (or $R^2$) and $R^3$ may be linked together via a carbon atom or a hetero atom (e.g., an oxygen atom, a nitrogen atom, a sulfur atom, etc.) to form a 5- or 6-membered hetero ring (e.g., a piperidine ring, a pyrrolidine ring, a morpholine ring, etc.).

Specific but non-limiting examples of the compounds represented by formula (I) which can be used in the present invention are shown below.

(1)

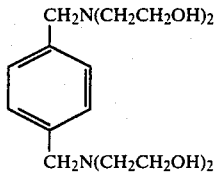

(2)

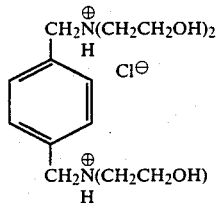

(3)

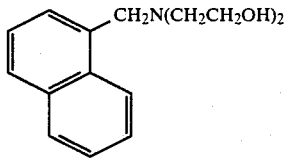

(4)

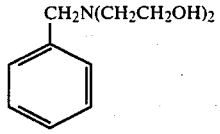

(5)

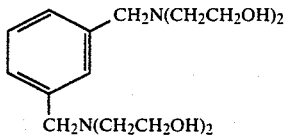

(6)

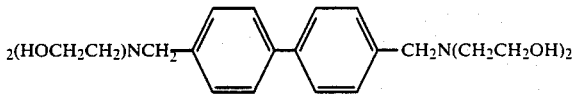

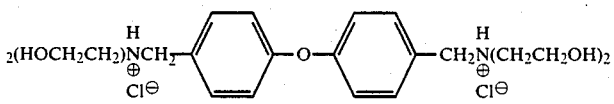

(7)

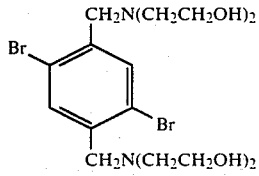

(8)

-continued
(9)
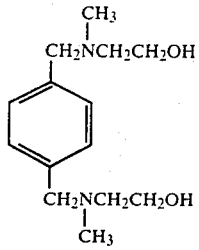
(10)
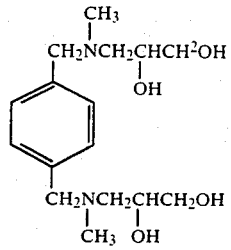
(11)
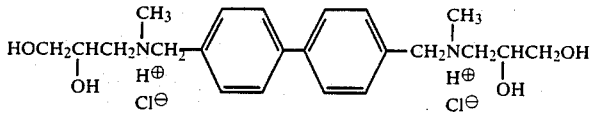
(12)
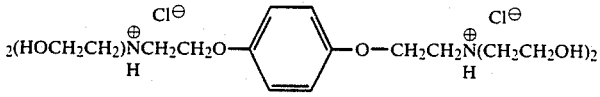
(13)
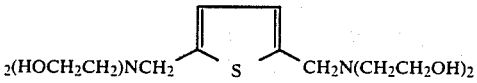
(14)
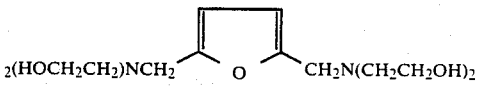
(15)
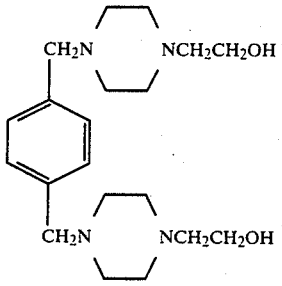
(16)
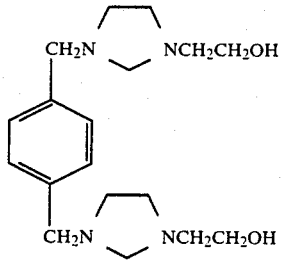
(17)
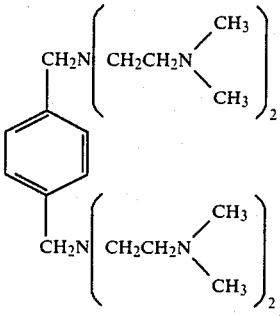
(18)
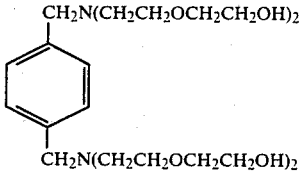
(19)
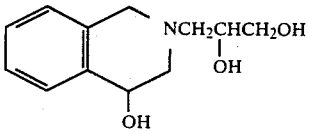
(20)
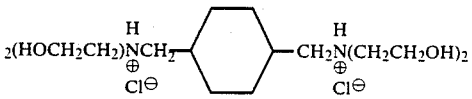
(21)
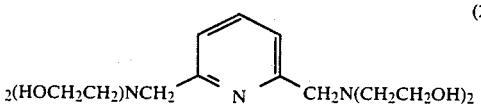
(22)
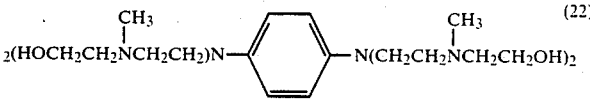
(23)
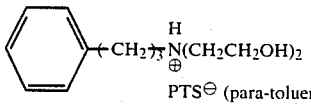
PTS⊖ (para-toluenesulfonate)
(24)
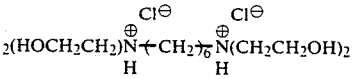

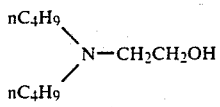

-continued

(25) 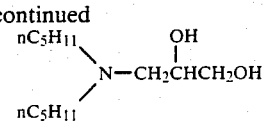 (26)

The compounds of formula (I) can be synthesized by well-known processes, such as those described in U.S. Pat. No. 4,552,834, Japanese Patent Publication No. 12056/79, and Japanese Patent Application (OPI) No. 192953/76.

The terminology "washing bath" as used in this invention means a bath whose main purpose is to wash away processing solution components which have been adhered to or absorbed in color light-sensitive materials as well as other components constituting the color light-sensitive materials, which should be removed for ensuring photographic performances or image stability after the processing. Recently, washing baths with reduced water are sometimes designated under the name of stabilizing bath, desalting bath, and the like. If the effects produced by these baths are mainly attributable to washing-off of processing solutions or components to be removed from the light-sensitive materials, these baths can be included in the washing bath hereinafter referred to.

The terminology "amount of the preceding bath which is carried over" as used herein means the volume of the preceding bath which has been adhered to and/or absorbed in the light-sensitive materials and is carried over into the washing bath. Such a volume can be determined by immersing in water a color light-sensitive material taken out immediately before entering into the washing bath to extract the components of the preceding bath under the conditions as described in Example 1 hereinafter described, and measuring the content of the components in the extract.

According to the present invention, washing in the washing bath is carried out in the presence of the compound of formula (I). This can be done, for example, by incorporating the compound of formula (I) in the color light-sensitive material and/or the washing bath.

Antifungal agents relevant to the compounds represented by formula (I) include quaternary ammonium salts that are added to a stabilizing bath as disclosed in U.S. Pat. No. 3,093,479. These quaternary ammonium salts seriously accelerate discoloration of a dye image after processing. To make a contrast, the compounds according to the present invention do not increase discoloration at all.

Some compounds represented by formula (I) have been proved effective as bleach accelerators as disclosed in U.S. Pat. No. 4,552,834. Nevertheless, it is hardly anticipated that such compounds accomplish entirely different effects as described above when applied to the washing bath according to the present invention.

In the case where the compound of formula (I) is incorporated in a color light-sensitive material, it is present in an amount of from $1\times10^{-5}$ to $1\times10^{-2}$ mol, and preferably from $2\times10^{-5}$ to $5\times10^{-3}$ mol, per square meter ($/m^2$) of the color light-sensitive material. In the case where it is incorporated in a washing bath, the amount to be added preferably ranges from $1\times10^{-5}$ to $1\times10^{-1}$ mol, and more preferably from $1\times10^{-4}$ to $5\times10^{-4}$ mol, per liter of the washing bath.

When the compound of formula (I) is incorporated in a color light-sensitive material only, if the amount of the replenishing water to be added to the washing bath exceeds 50 times the amount of the preceding bath which is carried over, the antifungal effect cannot be exerted. This is probably because the compound of formula (I) present in the light-sensitive material is substantially diluted and reduced when washed with a relatively large quantity of the replenished washing bath, failing to produce the desired effect after processing. On the other hand, when the compound of formula (I) is incorporated in the washing bath alone, if the amount of the replenishing water exceeds 50 times the amount of the preceding bath which is carried over, the antifungal effect can be obtained. However, such replenishment with a large excess of water not only deviates from the basic purpose of the present invention, i.e., a great saving of water, but results in poor economy.

The compound represented by formula (I) may be incorporated in any portion of color light-sensitive materials, but is preferably incorporated in the lower layer portion thereof in order to remain in the material after processing and to exhibit its effect. The lower layer portion includes, for example, an antihalation layer, an undermost emulsion layer or an intermediate layer above such an emulsion layer, of a multilayer color light-sensitive material.

When the compound of formula (I) is incorporated into a washing bath, it may be added directly to the washing bath or be added to replenishing water, with the latter being preferred.

The amount of replenishing water to be added to a washing bath is from 2 to 50 times, preferably from 3 to 50 times, and more preferably from 5 to 30 times, the amount of the carried preceding bath per unit area of the color light-sensitive material to be processed. With the amount of replenishing water exceeding 50 times, the objects of this invention cannot be achieved, as described above. If the amount of the replenishing water is less than twice, sufficient washing effects cannot be produced, resulting in formation of stains of the color light-sensitive materials. The washing bath has a pH value of from 4 to 10, preferably from 5 to 9, and more preferably from 6.5 to 8.5.

It is particularly desirable that at least the final tank of the tanks constituting the washing bath according to the present invention contains from $5\times10^{-4}$ to $1\times10^{-2}$ mol/liter of at least one compound selected from aminocarboxylic acids, aminophosphonic acids, phosphonic acids, phosphonocarboxylic acids and salts thereof. These additives, when used in the presence of the compounds of formula (I), function to further enhance the effects of the compound of formula (I).

Specific examples of the aminocarboxylic acids, aminophosphonic acids, phosphonic acids and phosphonocarboxylic acids are shown below:

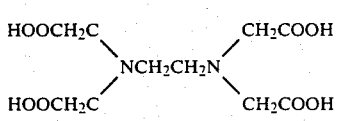 A-1

-continued

A-2

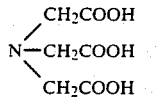

A-3

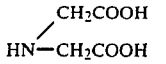

A-4

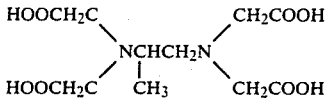

A-5

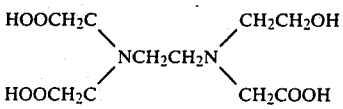

A-6

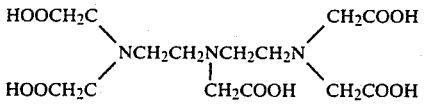

A-7

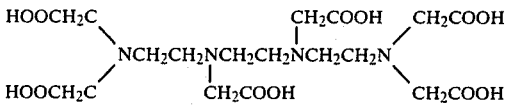

A-8

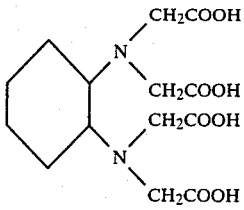

A-9

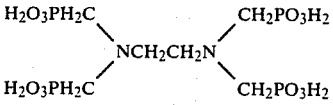

A-10

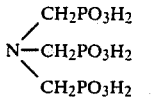

A-11

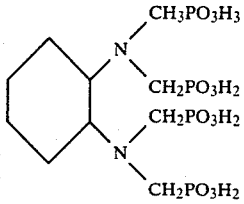

A-12

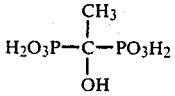

A-13

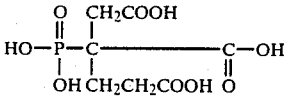

Salts of the above-described acids which can be used in the present invention include sodium salts, potassium salts, calcium salts, ammonium salts, magnesium salts, and the like, with sodium salts and potassium salts being preferred.

The amount of the aminocarboxylic acids, aminophosphonic acids, phosphonic acids, phosphonocarboxylic acids or salts thereof to be added to at least the final tank of the washing bath ranges from $5\times10^{-4}$ to $1\times10^{-2}$ mol/liter, and preferably from $6\times10^{-4}$ to $5\times10^{-3}$ mol/liter. When it is less than $5\times10^{-4}$ mol/liter, such produces no effect at all. Amounts exceeding $1\times10^{-2}$ mol/liter give unfavorable results, such that precipitates are formed on the surface of color light-sensitive materials after drying, or the color light-sensitive materials become sticky or are covered with scum. Incorporation of the aminocarboxylic acids or the like in the final tank of the washing bath can be effected in the same manner as described for the compounds of formula (I).

In addition to the above-described additives, the washing bath according to the present invention can contain other various compounds, such as a variety of buffering agents for pH adjustment (e.g., combinations of borates, metaborates, borax, phosphates, carbonates, potassium hydroxide, sodium hydroxide, aqueous ammonia, monocarboxylic acids, dicarboxylic acids, polycarboxylic acids, etc.), and aldehydes (e.g., formalin).

The washing bath may further contain various additives, such as surface active agents, fluorescent brightening agents, metal salts as hardening agents, and the like. Two or more compounds for the same or different purposes can be used in combination.

The washing bath may furthermore contain various ammonium salts as pH adjusters for processed films, such as ammonium chloride, ammonium nitrate, ammonium sulfate, ammonium phosphate, ammonium sulfite, ammonium thiosulfate, etc.

In cases when the bath preceding the washing bath has fixing ability, fixing components, such as thiosulfates, are to be carried over into the washing bath. In order to prevent sulfiding due to these components, a sulfite, such as sodium sulfite, potassium sulfite, ammonium sulfite, etc., can be added to the washing bath. Further, for the purpose of preventing proliferation of bacteria within the washing bath, sulfanilamide, benzotriazole, etc., can preferably be used.

The time of washing in the washing bath is usually from 10 seconds to 10 minutes, and preferably from 20 seconds to 5 minutes, though varying depending on the purpose or the type of color light-sensitive materials to be processed. The temperature of the washing bath is usually from 20° to 45° C., preferably from 25° to 40° C., and more preferably from 30° to 40° C.

For savings of water, application of a multi-stage countercurrent washing system using two or more washing tanks is preferred also in the present invention.

In the photographic light-sensitive materials which can be processed according to the present invention, silver halides which can be used in photographic emulsion layers may be any of silver bromide, silver iodobromide, silver iodochlorobromide, silver chlorobromide, and silver chloride. Preferred is silver iodobromide or silver iodochlorobromide containing not more than 30 mol% of silver iodide. More preferred is silver iodobromide containing from 2 to 25 mol% of silver iodide.

Silver halide grains in the photographic emulsion may have a regular crystal form, such as a cube, an octahedron, a tetradecahedron, etc., an irregular crystal form, such as a sphere, a plate, etc., a form with a crystal defect, such as a twin plane, etc., or a composite form thereof.

The silver halide grains may be fine grains having a particle size of 0.1 μm or smaller, or coarse grains whose projected area has a diameter reaching 10 μm. The silver halide emulsion may be either a mono-dispersed emulsion with a narrow grain size distribution or a poly-dispersed emulsion with a broad grain size distribution.

The photographic emulsions which can be used in the present invention can be prepared by known methods as described, e.g., in P. Glafkides, *Chimie et Physique Photographique,* Paul Montel (1967), G. F. Duffin, *Photographic Emulsion Chemistry,* Focal Press (1966), V. L. Zelikman et al., *Making And Coating Photographic Emulsion,* Focal Press (1964), etc. In more detail, the emulsion can be prepared by any of the acid process, the neutral process, the ammonia process, and the like. The reaction between soluble silver salts and soluble halogen salts can be carried out by any of a single jet process, a double jet process, a combination thereof, and the like. A so-called reverse mixing process, in which grains are formed in the presence of an excessive silver ion, can be employed. Further, a so-called controlled double jet process, in which the pAg of the liquid phase wherein silver halide grains are to be precipitated is maintained constant, can also be employed. According to this process, silver halide emulsions in which grains have a regular crystal form and an almost uniform size can be obtained. Two or more silver halide emulsions that are prepared separately may be used as a mixture.

The photographic emulsion comprising silver halide grains having a regular crystal form can be obtained by controlling the pAg and pH of the system during grain formation. For details, reference can be made, e.g., in *Photographic Science and Engineering,* Vol. 6, pp. 159–165 (1962), *Journal of Photographic Science,* Vol. 12, pp. 242–251 (1964), U.S. Pat. No. 3,655,394, and British Pat. No. 1,413,748.

The mono-dispersed emulsion is represented by such an emulsion in which the silver halide grains have a mean grain diameter greater than about 0.1 μm and at least about 95% by weight of the grains fall in the range within ±40% of the mean grain size. Mono-dispersed emulsions which can be used in the present invention include those in which silver halide grains have a mean grain size between about 0.25 and 2 μm and at least 95% of the weight or number of total silver halide grains is included in the size range within ±20% of the mean grain size. Processes for preparing such emulsions are described in U.S. Pat. Nos. 3,574,628 and 3,655,394 and British Pat. No. 1,413,748. The mono-dispersed emulsions described in Japanese Patent Application (OPI) Nos. 8600/73, 39027/76, 83097/76, 137133/78, 48521/79, 99419/79, 37635/83, and 49938/83, etc., can also be used to advantage in this invention.

Use of a silver halide photographic emulsion comprising plate-like (or tabular) grains achieves an increase in sensitivity including an increase in color sensitization efficiency ascribed to sensitizing dyes, an improvement in relation between sensitivity and graininess, an improvement in sharpness, an improvement in development progress, an improvement in covering power, an improvement in cross-over, and the like.

The plate-like silver halide grains are those having a diameter/thickness ratio of 5 (i.e., 5/1) or more, including those having such a ratio exceeding 8 or a ratio between 5 and 8.

The terminology "diameter of silver halide grains" as used herein means the diameter of a circle with an area equal to that of a projected area of grains. The diameter of the plate-like silver halide grains herein referred to ranges from 0.3 to 5.0 μm, and preferably from 0.5 to 3.0 μm. The thickness of these grains is not more than 0.4 μm, preferably not more than 0.3 μm, and more preferably not more than 0.2 μm. In general, plate-like silver halide grains have a plate form with two parallel planes, so that the term "thickness" as used above is represented by the distance between the two parallel planes constituting the plate-like silver halide grains.

It is possible to use these plate-like silver halide grains in the form of a mono-dispersion in terms of grain size and/or thickness of grains as described in Japanese Patent Publication No. 11386/72.

The terminology "mono-dispersion of plate-like silver halide grains" as used herein indicates a dispersion system in which 95% of the total grains falls within ±60%, and preferably ±40%, of the number average grain size of the emulsion. The terminology "number average grain size" means the number avarage diameter of a diameter of the projected area of silver halide grains.

In the plate-like silver halide emulsions to be used in this invention, the proportion of the plate-like grains is preferably at least 50%, more preferably at least 70%, and most preferably at least 90%, based on the total projected area.

A preferred halogen composition of the plate-like silver halide grains includes silver bromide, silver iodobromide, silver chlorobromide, silver chloroiodobromide, silver chloride, and silver iodochloride. Silver iodochloride is particularly preferred for use in high sensitivity light-sensitive materials. In the case of silver iodochloride, the silver iodide content is usually not more than 40 mol%, preferably not more than 20 mol%, and more preferably not more than 15 mol%. For use in light-sensitive materials for printing, silver chlorobromide and silver bromide are particularly preferred.

The plate-like grains may have a homogeneous halogen composition or comprise two or more phases with different halogen compositions. For example, if in using silver iodobromide, the individual silver iodobromide plate-like grains may have a layered structure composed of a plurality of phases having different iodide contents. Preferred examples of the halogen composition or intragranular halogen distribution of plate-like silver halide grains are described, e.g., in Japanese Patent Application (OPI) Nos. 113928/83 and 99433/84. It is generally desirable that the optimum relative relationship among iodide contents of different phases constituting the plate-like silver halide grains is chosen in accordance with factors of development processing (e.g., the amount of a silver halide solvent present in a developer) which is applied to the light-sensitive material containing such plate-like silver halide grains.

The plate-like silver halide grains can include fused silver halide crystals in which an oxide crystal (e.g., PbO) and a silver halide crystal (e.g., silver chloride) are fused together; epitaxial silver halide crystals, such as those comprising silver bromide crystals on which silver chloride, silver iodobromide or silver iodide is epitaxially grown, and those comprising hexagonal, regular octahedral silver iodide crystals on which silver chloride, silver bromide, silver iodide, or silver chloroiodobromide is epitaxially grown, etc.; and the like.

Specific examples of such crystals are described in U.S. Pat. Nos. 4,435,501 and 4,463,087, etc.

The plate-like silver halide grains may be either those in which a latent image is predominantly formed on their surfaces or those in which a latent image is predominantly formed inside the grains. Whether the grains are of the former type or the latter type can be selected depending on the end use of light-sensitive materials containing the plate-like silver halide grains or the developing capacity of a developer used, i.e., the depth of a latent image which can be developed with the developer.

A preferred embodiment of using the plate-like silver halide grains according to the present invention is described in detail in *Research Disclosure,* RD No. 22534 (Jan., 1983), and ibid., RD No. 25330 (May, 1985). In these references, there is disclosed a method of use based on a relationship between a thickness of plate-like grains and optical properties.

The crystal structure of silver halide grains may be homogeneous, or may have a halogen composition different between the core and the outer shell, or may have a layered structure. These emulsion grains are described, e.g., in British Pat. No. 1,027,146, U.S. Pat. Nos. 3,505,068 and 4,444,877, Japanese Patent Application (OPI) No. 248469/83, etc. Crystals with which a silver halide of different halogen composition is fused through epitaxy or crystals with which a compound other than silver halides, e.g., silver rhodanide, lead oxide, etc., is fused can also be used. These emulsion grains are disclosed, e.g., in U.S. Pat. Nos. 4,094,684, 4,142,900 and 4,459,353, British Pat. No. 2,038,792, U.S. Pat. Nos. 4,349,622, 4,395,478, 4,433,501, 4,463,087, 3,656,962, and 3,852,067 and Japanese Patent Application (OPI) No. 162540/84. A mixture of grains having various crystal forms may also be employed.

For acceleration of ripening, silver halide solvents are useful. For example, it is known that ripening can be accelerated in the presence of excess halogen ions in a reactor. It is obvious, therefore, that ripening can be accelerated by simply introducing a halide solution in the reactor. These and other ripening accelerators can be incorporated in a dispersion medium in a reactor all at once before addition of a silver salt and a halide, or incorporated in a reactor together with one or more of a halide, a silver salt, and a peptizer. Incorporation of the ripening accelerator may be effected independently of the addition of a halide and a silver salt.

Ripening accelerators other than halogen ions include ammonia, amine compounds and thiocyanates, such as alkali metal (e.g., sodium and potassium) thiocyanates, and ammonium thiocyanate. Use of the thiocyanate ripening accelerators is taught in U.S. Pat. Nos. 2,222,264, 3,448,534 and 3,320,069. In addition, commonly employed thioether ripening accelerators as described in U.S. Pat. Nos. 3,271,157, 3,574,628, and 3,737,313, and thione compounds as described in Japanese Patent Application (OPI) Nos. 82408/78 and 144319/78 can also be used.

Properties of silver halide grains can be controlled in the presence of various compounds during formation of silver halide precipitates. Such compounds may be present in the reactor from the beginning or be added simultaneously with the usual addition of one or more salts. Specific examples of such compounds include compounds of copper, iridium, lead, bismuth, cadmium, zinc, chalcogens (e.g., sulfur, selenium and tellurium), gold and noble metals of the Group VII, as described, e.g., in U.S. Pat. Nos. 2,448,060, 2,628,167, 3,737,313, and 3,772,031 and *Research Disclosure,* Vol. 134, RD No. 13452 (June, 1975). Silver halide emulsions can be subjected to internal reduction sensitization during grain formation as described in Japanese Patent Publication No. 1410/83 and Moisar et al., *Journal of Photographic Science,* Vol. 25, pp. 19–27 (1977).

Silver halide emulsions are usually subjected to chemical sensitization. Chemical sensitization can be carried out by using active gelatin as described in T. H. James, *The Theory of the Photographic Process,* 4th Ed., pp. 67–76, Macmillan (1977), or using sulfur, selenium, tellurium, gold, platinum, palladium, iridium, or a combination of these sensitizers at a pAg of from 5 to 10, a pH of 5 to 8 and a temperature of from 30° to 80° C. as described in *Research Disclosure,* Vol. 120, RD No. 12008 (April, 1974), ibid., Vol. 34, RD No. 13452 (June, 1975), U.S. Pat. Nos. 2,642,361, 3,297,446, 3,772,031, 3,857,711, 3,901,714, 4,266,018, and 3,904,415 and British Pat. No. 1,315,755. The optimum chemical sensitization can be performed in the presence of a gold compound and a thiocyanate compound; a sulfur-containing compound is disclosed in U.S. Pat. Nos. 3,857,711, 4,266,018, and 4,054,457; or a sulfur-containing compound, such as hypo, thiourea compounds, rhodanine compounds, etc. Chemical sensitization may be effected in the copresence of a chemical sensitization aid, such as compounds known to inhibit fog and increase sensitivity during chemical sensitization, e.g., azaindene, azapyridazine, azapyrimidine, etc. Examples of modifiers for chemical sensitization aids are described in U.S. Pat. Nos. 2,131,038, 3,411,914, and 3,554,757, Japanese Patent Application (OPI) No. 126526/83 and G. F. Duffin, *Photographic Emulsion Chemistry,* pp. 138–143, Focal Press (1966). Chemical sensitization can be combined with or substituted by reduction sensitization. Reduction sensitization can be carried out by using hydrogen as described in U.S. Pat. Nos. 3,891,446 and 3,984,249; by using a reducing agent, e.g., stannous chloride, thiourea dioxide, polyamines, etc., as described in U.S. Pat. Nos. 2,518,698, 2,743,182, and 3,743,183; or by treating at a low pAg (e.g., less than 5) and/or at a high pH (e.g., more than 8). The chemical sensitization method as disclosed in U.S. Pat. Nos. 3,917,485 and 3,966,476 can also be adopted to increase color sensitivity.

The silver halide photographic emulsions which can be used in the present invention may be spectrally sensitized with methine dyes or others. Sensitizing dyes to be used include cyanine dyes, merocyanine dyes, complex cyanine dyes, complex merocyanine dyes, holopolar cyanine dyes, hemicyanine dyes, styryl dyes and hemioxonol dyes. Of these, cyanine dyes, merocyanine dyes and complex merocyanine dyes are particularly useful. Any of the basic heterocyclic nuclei usually employed for cyanine dyes can be applied to the above-described dyes. Examples of such nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; the above-enumerated nuclei to which an alicyclic hydrocarbon ring is fused; and the above-enumerated nuclei to which an aromatic hydrocarbon ring is fused, e.g, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzamidazole nucleus, a quinoline nucleus, etc. These nuclei may have substitutents on their carbon atoms.

A 5- to 6-membered heterocyclic nucleus having a ketomethylene structure can be applied to the merocyanine dyes or complex merocyanine dyes. Examples of such a nucleus include a pyrazoline-5-one nucleus, thiohydantoin nucleus, a 2-thiooxazolidin-2,4-dione nucleus, a thiazolidine-2,4-dione nucleus, a rhodanine nucleus, a thiobarbituric acid nucleus, etc.

The above-described sensitizing dyes may be used either individually or in combinations thereof. In particular, combinations of sensitizing dyes are frequently used for the purpose of supersensitization. Emulsions may also contain a substance which does not per se show spectral sensitizing activity or does not substantially absorb visible light, but which exhibits supersensitizing activity when used together with the sensitizing dye. Examples of such a substance are aminostibene compounds substituted with a nitrogen-containing heterocyclic ring (e.g., those described in U.S. Pat. Nos. 2,933,390 and 3,635,721), aromatic organic acid-formaldehyde condensation products (e.g., those described in U.S. Pat. No. 3,743,510), cadmium salts, azaindene compounds, and the like. The combinations described in U.S. Pat. Nos. 3,615,613, 3,615,641, 3,617,295, and 3,635,721 are particularly useful.

Spectral sensitization of the emulsions can be conducted at any stage through the preparation of emulsions. In general, spectral sensitizing dyes are added to chemically sensitized emulsions before coating. The spectral sensitizing dyes may be added to the emulsion before or during chemical sensitization as disclosed in U.S. Pat. No. 4,425,426, etc. They may also be added to the emulsion before completion of grain formation as disclosed in U.S. Pat. Nos. 2,735,766, 3,628,960, 4,183,756, and 4,255,666. In particular, the last two patents suggest that addition of spectral sensitizing dyes to an emulsion after stable nucleation for grain formation brings about advantages, such as an increase in photographic sensitivity, enhanced adsorption of the spectral sensitization dye onto silver halide grains, an the like.

For the purpose of increasing sensitivity or contrast or accelerating development, the photographic emulsions can contain polyalkylene oxides or derivatives thereof, e.g., ethers, esters and amines, thioether compounds, thiomorpholines, quaternary ammonium salt compounds, urethane derivatives, urea derivatives, imidazole derivatives, 3-pyrazolidones, and the like. Specific examples of these compounds are described, e.g., in U.S. Pat. Nos. 2,400,532, 2,423,549, 2,716,062, 3,617,280, 3,772,021, and 3,808,003 and British Pat. No. 1,488,991.

In addition, the photographic emulsions can further contain a variety of compounds known as antifoggants or stabilizers for the purpose of preventing fog during the preparation, preservation or processing of the light-sensitive materials or stabilizing photographic performances. Such compounds include azoles, e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.; mercaptopyrimidines; mercaptotriazines; thioketo compounds, e.g., oxazolinethione, etc.; azaindenes, e.g., triazaindenes, tetraazaindenes (particularly, 4-hydroxysubstituted(1,3,3a,7)tetraazaindenes), pentaazaindenes, etc.; benzenethiosulfonic acid, benzenesulfinic acid, benzenesulfonic acid amide, and the like.

In the present invention, a wide variety of color couplers can be used. Color couplers are compounds capable of coupling with an oxidation product of an aromatic primary amine developing agent to form dyes. Useful color couplers typically include naphthol or phenol compounds, pyrazolone or pyrazoloazole compounds and open-chain or heterocyclic ketomethylene compounds. Specific examples of these cyan, magenta, and yellow couplers which can be used in the present invention are described in patents cited in *Research Disclosure,* RD No. 17643, VII-D (December, 1978), and ibid., RD No. 18717 (November, 1979).

The color couplers to be incorporated in light-sensitive materials are preferably rendered nondiffusive by introduction of ballast groups or polymerizing. Two-equivalent couplers with their coupling active site being substituted with a coupling releasable group are preferred to 4-equivalent couplers with their coupling active site being a hydrogen atom in view of reduction in silver coverage required. In addition, couplers which produce dyes with moderate diffusibility, colorless couplers, DIR couplers capable of releasing a development inhibitor upon coupling, or couplers capable of releasing a development accelerator upon coupling may also be employed.

Typical examples of the yellow couplers to be used in this invention are oil-protected type acylacetamide couplers, with their specific examples being described in U.S. Pat. Nos. 2,407,210, 2,875,057, and 3,265,506. In the present invention, 2-equivalent yellow couplers are preferably used. Typical examples of the 2-equivalent yellow couplers are those of oxygen atom release type as described, e.g., in U.S. Pat. Nos. 3,408,194, 3,447,928, 3,933,501, and 4,022,620; and those of nitrogen atom release type as described, e.g., in Japanese Patent Publication No. 10739/83, U.S. Pat. Nos. 4,401,752 and 4,326,024, *Research Disclosure,* RD No. 18053 (April, 1979), British Pat. No. 1,425,020, West German Patent Publication Nos. 2,219,917, 2,261,361, 2,329,587, and 2,433,812, etc. α-Pivaloyl acetanilide couplers produce dyes having excellent fastness, particularly to light, and α-benzoylacetanilide couplers provide high color densities.

The magenta couplers which can be used in the present invention include oil-protected type indazolone or cyanoacetyl couplers, and preferably 5-pyrazolone couplers and pyrazoloazole couplers, e.g., pyrazolotriazoles. The 5-pyrazolone couplers are preferably substituted with an arylamino group or an acylamino group at the 3-position thereof from the standpoint of the hue or density of the formed dyes. Typical examples of such 3-substituted 5-pyrazolone couplers are described in U.S. Pat. Nos. 2,311,082, 2,343,703, 2,600,788, 2,908,573, 3,062,653, 3,152,896, and 3,936,015. Releasable groups for the 2-equivalent 5-pyrazolone couplers preferably include nitrogen atom-releasable groups disclosed in U.S. Pat. No. 4,310,619 and arylthio groups described in U.S. Pat. No. 4,351,897. The 5-pyrazolone couplers having the ballast groups as described in European Pat. No. 73,636 provide high color densities.

The pyrazoloazole couplers include pyrazolobenzimidazoles described in U.S. Pat. No. 3,061,432, and preferably pyrazolo[5,1-c][1,2,4]triazoles described in U.S. Pat. No. 3,725,067; pyrazolotetrazoles as described in *Research Disclosure,* RD No. 24220 (June, 1984) and Japanese Patent Application (OPI) No. 33552/85; and pyrazolopyrazoles described in *Research Disclosure*, RD No. 24230 (June, 1984) and Japanese Patent Application (OPI) No. 43659/85. From the viewpoint of unnecessary yellow absorption or light-fastness of developed dyes, imidazo[1,2-b]pyrazoles described in U.S. Pat. No. 4,500,630 are preferred, and pyrazolo[1,5-b][1,2,4]triazole disclosed in U.S. Pat. No. 4,540,654 is particularly preferred.

The cyan couplers which can be used in the present invention include oil-protected type naphthol and phenol couplers. Typical examples thereof are the naphthol couplers described in U.S. Pat. No. 2,474,293, and preferably oxygen atom release type 2-equivalent naphthol couplers described in U.S. Pat. Nos. 4,052,212, 4,146,396, 4,228,233, and 4,296,200. Specific examples of the phenol couplers are given in U.S. Pat. Nos. 2,369,929, 2,801,171, 2,772,162, and 2,895,826, etc. Cyan couplers exhibiting fastness to moisture and heat are suitably used in the present invention. Such couplers typically include phenol couplers having an alkyl group containing 2 or more carbon atoms at the metaposition of the phenol nuclei as described in U.S. Pat. No. 3,772,002; 2,5-diacylamino-substituted phenol couplers as described in U.S. Pat. Nos. 2,772,162, 3,758,308, 4,126,396, 4,334,011, and 4,327,173, West German Patent Publication No. 3,329,729, European Pat. No. 121,365, etc.; and phenol couplers having a phenylureido group at the 2-position and an acylamino group at the 5-position as described in U.S. Pat. Nos. 3,446,622, 4,333,999, 4,451,559, and 4,427,767, etc. Naphthol couplers having a sulfonamido group, an amido group, etc. at the 5-position of the naphthol nucleus as described in Japanese Patent Application (OPI) No. 237448/85 and EP Publication No. 161626 also produce dye images excellent in fastness and are, therefore, preferably used in this invention.

In order to correct unnecessary absorption in the short wavelength region possessed by the dyes produced from the magenta and cyan couplers, it is desirable to use colored couplers in combination in color negative photographic light-sensitive materials. Typical examples of the colored couplers are yellow-colored magenta couplers as described in U.S. Pat. No. 4,163,670 and Japanese Patent Publication No. 39413/82 and magenta-colored cyan couplers as described in U.S. Pat. Nos. 4,004,929 and 4,138,258 and British Pat. No. 1,146,368.

The combined use of magenta and cyan couplers which produces a dye with moderate diffusibility achieves an improvement in graininess. Specific examples of such couplers are shown in U.S. Pat. No. 4,366,237 and British Pat. No. 2,125,570 as for magenta couplers; and in European Pat. No. 96,570 and West German Patent Publication No. 3,234,533 as to yellow, magenta, and cyan couplers.

The dye-forming couplers and the above-described special couplers may be in the form of a polymer inclusive of a dimer. Typical examples of polymerized dye-forming couplers are described in U.S. Pat. Nos. 3,451,820 and 4,080,211. Specific examples of polymerized magenta couplers are described in British Pat. No. 2,102,173, U.S. Pat. No. 4,367,282 and Japanese Patent Application Nos. 75041/85 and 11359/85.

In an attempt of satisfying characteristic requirements for light-sensitive materials, a combination of two or more kinds of various couplers may be used in the same layer, or one kind of couplers may be introduced into two or more different layers.

The standard amount of color couplers to be used ranges from 0.001 to 1 mol per mol of a light-sensitive silver halide. More specifically, the amount of yellow couplers to be used is from 0.01 to 0.5 mol; that of magenta couplers is from 0.003 to 0.3 mol; and that of cyan couplers is from 0.002 to 0.3 mol, per mol of the light-sensitive silver halide.

The light-sensitive materials of the present invention can further contain a so-called DIR coupler which releases a development inhibitor upon development. DIR couplers which can be used include those capable of releasing a heterocyclic mercapto type development inhibitor as described in U.S. Pat. No. 3,227,554; those capable of releasing a benzotriazole derivative as described in Japanese Patent Publication No. 9942/83; the so-called colorless DIR couplers as described in Japanese Patent Publication No. 16141/76; those capable of releasing a nitrogen-containing heterocyclic development inhibitor, accompanied by decomposition of methylol after their release, as described in Japanese Patent Application (OPI) No. 90932/77; those capable of releasing a development inhibitor through intramolecular nucleophilic reaction after their release, as described in U.S. Pat. No. 4,248,962 and Japanese Patent Application (OPI) No. 56837/82; those capable of releasing a development inhibitor through electron transfer via a conjugated system after their release, as described in Japanese Patent Application (OPI) Nos. 114946/81, 154234/82, 188035/82, 98728/83, and 209736/83, 209737/83, 209738/83, 209739/83, and 209740/83; those capable of releasing a diffusive development inhibitor which is inactivated in a developing solution as described in Japanese Patent Application (OPI) Nos. 151944/82 and 217932/83; and those capable of releasing a reactive compound which forms a development inhibitor or deactivates a development inhibitor through reaction within a film at the time of development, as described in Japanese Patent Application (OPI) Nos. 182438/85 and 184248/85. Among the above-recited DIR couplers, the preferred for a combination with the present invention are developer-inactivated types as exemplified by Japanese Patent Application (OPI) No. 151944/82; timing types as exemplified by U.S. Pat. No. 4,248,962 and Japanese Patent Application (OPI) No. 15423/82; and reactive types as exemplified by Japanese Patent Application (OPI) No. 184248/85. The most preferred are developer-inactivated types described in Japanese Patent Application (OPI) No. 151944/82, 217932/83, 218644/85, 225156/85, and 233650/85; and reactive types described in Japanese Patent Application No. 39653/84.

The light-sensitive materials of the present invention can contain a compound capable of imagewise releasing a nucleating agent or a precursor thereof or a development accelerator or a precursor thereof (hereinafter simply referred to as "development accelerator, etc."). Typical examples of such a compound are the so-called DAR (development accelerator releasing) couplers capable of releasing a development accelerator, etc., upon coupling reaction with an oxidation product of an aromatic primary amine developing agent as described in British Pat. Nos. 2,097,140 and 2,131,188.

The development accelerator, etc., released from the DAR coupler preferably has a group adsorptive onto silver halides. Specific examples of the adsorptive group-containing DAR coupler are described in Japanese Patent Application (OPI) Nos. 157638/84 and 170840/84. DAR couplers which form an N-acyl-substituted hydrazine having a monocyclic or condensed hetero ring as an adsorptive group which is released from the coupling active position via a sulfur atom or a nitrogen atom are particularly preferred. Specific examples of such DAR couplers are described in Japanese Patent Application (OPI) No. 128446/85.

Compounds having a development accelerator moiety in their coupler residue as described in Japanese Patent Application (OPI) No. 37556/85 or compounds capable of releasing a development accelerator through oxidation-reduction reaction with a developing agent as described in Japanese Patent Application (OPI) No. 107029/85 can also be used in the light-sensitive materials of the invention.

It is preferable that the DAR coupler be introduced in a light-sensitive silver halide emulsion layer and that at least one of the photographic constituting layers contain substantially light-insensitive silver halide grains.

The light-sensitive materials prepared by the present invention can contain, as a color fog preventing agent or color mixing preventing agent, a hydroquinone derivative, an aminophenol derivative, an amine, a gallic acid derivative, a catechol derivative, an ascorbic acid derivative, a colorless couplers, a sulfonamidophenol derivative, and so on.

The light-sensitive materials of the present invention can further contain a known discoloration inhibitor, such as hydroquinones, 6-hydroxychromans, 5-hydroxycoumarans, spirochromans, p-alkoxyphenols, hindered phenols mainly derived from bisphenols, gallic acid derivatives, methylenedioxybenzenes, aminophenols, hindered amines, and ether or ester derivatives thereof in which the phenolic hydroxyl group is silylated or alkylated. In addition, metal complexes including a (bissalicylaldoximato)nickel complex and a (bis-N,N-dialkyldithiocarbamato)nickel complex can also be used to the same effect.

Hydrophilic colloidal layers of the light-sensitive materials of this invention can contain an ultraviolet absorbent. Examples of useful ultraviolet absorbents include aryl-substituted benzotriazoles as described in U.S. Pat. Nos. 3,553,794 and 4,236,013, Japanese Patent Publication No. 6540/76 and European Pat. No. 57,160; butadienes as described in U.S. Pat. Nos. 4,450,229 and 4,195,999; cinnamic esters as described in U.S. Pat. Nos. 3,705,805 and 3,707,375; benzophenones as described in U.S. Pat. No. 3,215,530 and British Pat. No. 1,321,355; and high polymeric compounds having an ultraviolet absorbing residue as described in U.S. Pat. Nos. 3,761,272 and 4,431,726. Ultraviolet absorbing fluorescent brightening agents as described in U.S. Pat. Nos. 3,499,762 and 3,700,455 may be used. Typical examples of the ultraviolet absorbents are described, e.g., in *Research Disclosure,* RD No. 24239 (June, 1984).

The light-sensitive materials of the present invention may contain one or more surface active agents for various purposes including coating aid, prevention of static charge, improvement of slipperiness, improvement of emulsifiability or dispersibility, prevention of adhesion, improvement in photographic characteristics (for example, acceleration of development, increase in contrast, and increase in sensitivity), and the like.

The hydrophilic colloidal layers of the light-sensitive materials may further contain a water-soluble dye as a filter dye or for various other purposes, such as opecifying, prevention of irradiation or antihalation. Such a water-soluble dye preferably includes oxonol dyes, hemixonol dyes, styryl dyes, merocyanine dyes, anthraquinone dyes and azo dyes. In addition, cyanine dyes, azomethine dyes, triarylmethane dyes and phthalocyanine dyes are also useful. It is also possible that an oil-soluble dye is emulsified by an oil-in-water dispersion method and added to the hydrophilic colloidal layer.

Methods for introducing oleophilic compounds, such as photographic couplers, to hydrophilic organic colloidal layers include various methods, such as an oil-in-water dispersion method, a latex dispersion method, a solid dispersion method, an alkali dispersion method, and the like. An appropriate method is selected therefrom in accordance with the chemical structure and physiochemical properties of the compound to be introduced.

In some detail, the photographic couplers of the present invention can suitably be added to one or more silver halide emulsion layers by a latex dispersion method, and more preferably an oil-in-water dispersion method. When the oil-in-water dispersion method is followed, the coupler is dissolved in a high-boiling point organic solvent having a boiling point of 175° C. or higher under atmospheric pressure (hereinafter referred to as oil), if necessary, in combination with a low-boiling point auxiliary solvent, and the solution is then finely dispersed in water or an aqueous binder solution, e.g., gelatin, preferably in the presence of a surface active agent.

Typical examples of the high-boiling point organic solvent include phthalates (e.g., those described in U.S. Pat. Nos. 2,272,191 and 2,322,027 and Japanese Patent Application (OPI) Nos. 31728/79 and 118246/79); phosphates or phosphonates (e.g., those described in Japanese Patent Application (OPI) Nos. 1520/78 and 36869/80 and U.S. Pat. Nos. 3,676,137, 4,217,410, 4,278,757, 4,326,022, and 4,353,979; benzoates (e.g., those described in U.S. Pat. No. 4,080,209; amides (e.g., those described in U.S. Pat. Nos. 2,533,514, 4,106,940, and 4,127,413; alcohols or phenols (e.g., those described in Japanese Patent Application (OPI) Nos. 27922/76, 13414/78, and 130028/78 and U.S. Pat. No. 2,835,579; aliphatic carboxylic esters (e.g., those described in Japanese Patent Application (OPI) Nos. 26037/76, 27921/76, 149028/76, 34715/77, 1521/78, 15127/78, 58027/79, 64333/81, and 14940/81 and U.S. Pat. Nos. 3,748,141, 3,779,765, 4,004,928, 4,430,421, and 4,430,422; anilines (e.g., those described in Japanese Patent Application (OPI) No. 62632/75; hydrocarbons (e.g., those described in Japanese Patent Application (OPI) Nos. 62632/75 and 99432/79 and U.S. Pat. No. 3,912,515; and other solvents as described in Japanese Patent Application (OPI) No. 146622/78, U.S. Pat. Nos. 3,689,271, 3,700,454, 3,764,336, 3,765,897, 4,075,022, and 4,239,851 and West German Patent Publication No. 2,410,914. These high-boiling point organic solvents may be used in combinations of two or more thereof, as in the case of using a combination of a phthalate and a phosphate as described in U.S. Pat. No. 4,327,175.

Incorporation of oleophilic compounds in hydrophilic organic colloidal layers can also be effected by a dispersion method using polymers as described in Japanese Patent Application (OPI) No. 59943/76, Japanese Patent Publication Nos. 39853/76 and 126830/81, and U.S. Pat. Nos. 2,772,163 and 4,201,589.

Binders or protective colloids to be used in emulsion layers or intermediate layers of the light-sensitive materials include gelatin to advantage. Other hydrophilic colloids which can be used as well include proteins, such as gelatin derivatives, graft polymers or gelatin and other high polymers, albumin, casein, etc.; sugar derivatives, e.g., cellulose derivatives (e.g., hydroxyethyl cellulose, carboxymethyl cellulose, cellulose sulfate, etc.), sodium alginate, starch derivatives, etc.; and various hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, and copolymers comprising monomers constituting these homopolymers.

Gelatin to be used includes commonly employed lime-processed gelatin, and, in addition, acid-processed gelatin, enzyme-processed gelatin, as described in *Bull. Soc. Sci. Phot. Japan, No.* 16, p. 30 (1966), and hydrolysis products of gelatin.

Any optional hydrophilic colloidal layer which constitutes the photographic light-sensitive layers or the backing layer may contain an organic or inorganic hardening agent, such as chromium salts, aldehydes (e.g., formaldehyde, glyoxal, glutaraldehyde, etc.), N-methylol compounds (e.g., dimethylolurea, etc.), and the like. Active halogen compounds (e.g., 2,4-dichloro-6-hydroxy-1,3,5-triazine, etc.) and active vinyl compounds (e.g., 1,3-bisvinylsulfonyl-2-propanol, 1,2-bisvinylsulfonylacetamidoethane, vinyl polymers having a vinylsulfonyl group in their side chains, etc.) are preferably used since they rapidly harden hydrophilic colloids (e.g., gelatin) to provide stable photographic characteristics. N-Carbamoylpyridium salts and haloamidinium salts are also preferred because of their high rates of hardening.

The present invention can be applied to multilayer multi-color photographic materials comprising a support having provided thereon at least two layers differing in spectral sensitivity. Multilayer natural color photographic materials usually comprise a support having provided thereon at least one red-sensitive emulsion layer, at least one green-sensitive emulsion layer and at least one blue-sensitive emulsion layer. The order of these layers can be selected depending upon the particular purpose. A preferred layer structure comprises a support, a red-sensitive emulsion layer, a green-sensitive emulsion layer and a blue-sensitive emulsion layer in this order. An emulsion layer may be composed of two or more layers being sensitive to the same color but having different sensitivity, to thereby improve the overall sensitivity. An emulsion layer may have a three-layered structure to have improved graininess. A light-insensitive layer may be interposed between a pair of emulsion layers being sensitive to the same color.

The multilayer multi-color photographic materials may contain a filter layer which absorbs light of a specific wavelength or a layer for prevention of halation. The light-absorbing layer can contain the above-described organic dyes as well as colloidal silver grains.

For the purpose of increasing sensitivity due to light reflection or trapping of a development restrainer, one or more light-insensitive layers may comprise a light-insensitive fine silver halide emulsion.

In general, a red-sensitive emulsion layer contains a cyan (i.e., cyan-dye-forming) coupler; a green-sensitive emulsion layer contains a magenta coupler; and a blue-sensitive emulsion layer contains a yellow coupler. Some light-sensitive materials may have other combinations. For example, an infrared-sensitive layer may be combined to produce false color films or films for exposure with a semi-conductor laser. Incorporation of a coupler which develops a color other than the color complementary to the wavelength to which a layer is sensitive is effective to remove unnatural color reproduction owing to excessive inter-layer effects of DIR couplers.

In the production of photographic light-sensitive materials, the photographic emulsion layers and other layers are coated on a commonly employed flexible support, such as plastic films, paper, cloth, etc., or a rigid support, such as glass, ceramics, metals, etc. Examples of useful flexible supports include films made of semi-synthetic or synthetic high polymers, e.g., cellulose nitrate, cellulose acetate, cellulose acetate butyrate, polystyrene, polyvinyl chloride, polyethylene terephthalate, polycarbonate, etc., and paper coated or laminated with a baryta layer or an $\alpha$-olefin polymer (e.g., polyethylene, polypropylene, an ethylene-butene copolymer, etc.). The support may be colored with a dye or a pigment, for example, black for the purpose of light shielding. The surface of the support is generally subjected to a subbing treatment in order to improve adhesion to photographic emulsion layers, and the like. Before the stubbing treatment, the surface of the support may be subjected to glow discharge, corona discharge, ultraviolet irradiation, flame treatment, and the like.

Coating of photographic emulsion layers and other hydrophilic colloidal layers on the support is carried out by any of various known coating methods, such as dip coating, roller coating, curtain coating, extrusion coating, etc. If desired, multiple layers may be coated simultaneously by the coating method described in U.S. Pat. Nos. 2,681,294, 2,761,791, 3,526,528, and 3,508,947.

The light-sensitive materials of the present invention can be exposed to light by various means. Light sources that can be employed include any of those emitting radiation corresponding to the sensitive wavelength of the light-sensitive materials, generally including natural light (sunlight), incandescent lamps, halogen lamps, mercury lamps, fluorescent lamps and flash light sources, e.g., an electronic flash and a flash bulb. Lasers of gases, dye solutions or semi-conductors, light-emitting diodes and plasma light sources may also be used as a light source for recording. In addition, a fluorescent screen which emits a visible light from a fluorescent substance exited by electron rays, etc. (e.g., CRT, etc.) and a combination of a micro-shutter array utilizing LCD (light crystal display) or PLZT (lanthanum-doped lead zirconate titanate) and a linear or planar light source may also be used as an exposure means. If desired, the spectral distribution to be used for an exposure can be controlled by using a color filter.

A color developer which can be used for development processing of the light-sensitive materials is preferably an alkaline aqueous solution mainly comprising an aromatic primary amine color developing agent. The color developing agent includes aminophenol compounds, and preferably p-phenylenediamine compounds. Typical examples of the p-phenylenediamine developing agent are 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides, phosphates, tetraphenylborates, p-(t-octyl)benzenesulfonates thereof. These diamines are generally more stable and are, therefore, more favorable in the form of a salt than in a free form.

Examples of the aminophenol developing agent include o- or p-aminophenol, 4-amino-2- or 3-methylphenol, 2-hydroxy-3-amino-1,4-dimethylbenzene, etc.

In addition, developing agents disclosed in L. F. A. Mason, *Photographic Processing Chemistry,* pp. 226–229, Focal Press (1966), U.S. Pat. Nos. 2,193,015 and 2,592,364, and Japanese Patent Application (OPI) No. 64933/73 may also be used. These color developing agents may be used in combinations of two or more thereof, if desired.

The color developer can contain various additives, such as pH-buffering agents, e.g., alkali metal carbonates, borates or phosphates, etc.; development restrainers or antifoggants, e.g., bromides, iodides, benzimidazoles, benzothiazoles, mercapto compounds, etc.; preservatives, e.g., hydroxylamine, triethanolamine, the compounds described in West German Patent Application (OLS) No. 2,622,950, sulfites, bisulfites, etc.; organic solvents, e.g., diethylene glycol, etc.; development accelerators, e.g., benzyl alcohol, polyethylene glycol, quaternary ammonium salts, amines, thiocyanates, 3,6-thiaoctane-1,8-diol, etc.; dye forming couplers; completing couplers; nucleating agents, e.g., sodium boron hydride, etc.; auxiliary developing agents, e.g., 1-phenyl-3-pyrazolidone, etc.; viscosity-imparting agents; and chelating agents, e.g., aminopolycarboxylic acids (e.g., ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, the compounds disclosed in Japanese Patent Application (OPI) No. 195845/83, etc.), 1-hydroxyethylidene-1,1'-diphosphonic acid, organic phosphonic acids disclosed in *Research Disclosure,* RD No. 18170 (May, 1979), aminophosphonic acids (e.g., aminotris(methylenephosphonic acid), ethylenediamine-N,N,N'-N'-tetramethylenephosphonic acid, etc.), phosphonocarboxylic acids disclosed in Japanese Patent Application (OPI) Nos. 102726/77, 42730/78, 121127/79, 4024/80, 4025/80, 126241/80, 65955/80, and 65956/80, and *Research Disclosure,* RD No. 19170 (May, 1979), etc.

The color developing agent is usually used in concentrations of from about 0.1 g to about 30 g, and preferably from about 1 g to about 15 g, per liter of a color developer. The color developer usually has a pH of 7 or higher, and preferably from about 9 to 13. The amount of a replenisher for a color developer can be reduced by controlling its concentrations of halides, color-developing agents, and the like.

In development processing of reversal color light-sensitive materials, color development is usually preceded by black-and-white development. The black-and-white developer contains one or more of known black-and-white developing agents, such as dihydroxybenzenes (e.g., hydroquinone, hydroquinone monosulfonate, etc.), 3-pyrazolidones (e.g., 1-phenyl-3-pyrazolidone, etc.) aminophenols (e.g., N-methyl-p-aminophenol, etc.), and the like.

After the color development, the photographic emulsion layers are usually subjected to bleach processing. The bleach processing may be effected simultaneously with fixing in a bleach-fix bath (blix), or these processings may be effected separately. In order to achieve rapid processing, bleach may be followed by blix. Bleaching agents to be used in bleach or blix processing include compounds of polyvalent metals, such as iron (III), cobalt (III), chromium (IV), copper (II), etc. (e.g., ferricyanides); peracids; quinones; nitroso compounds, bichromates; organic complex salts formed by Fe (III) or Co (III) and organic acids, such as aminopolycarboxylic acids (e.g., ethylenediaminetetraacetic acid, diethylenetriaminepentaacetic acid, etc.), aminopolyphosphonic acids, phosphonocarboxylic acids, organic phosphonic acids, citric acid, tartaric acid, malic acid, etc.; persulfates; hydrogen peroxide; permanganates; and the like. Of these, organic complex salts of Fe (III) and persulfates are preferred from the standpoint of rapid processing and prevention of environmental pollution. Specific examples of the aminopolycarboxylic acids or aminopolyphosphonic acids or salts thereof which are useful for formation of the organic complex salts of iron (III) are ethylenediaminetetraacetic acid, diethylenetriaminepentaacetic acid, ethylenediamine-N-(β-hydroxyethyl)-N,N',N'-triacetic acid, 1,2-diaminopropanetetraacetic acid, triethylenetetraminehexaacetic acid, propylenediaminetetraacetic acid, nitrilotriacetic acid, nitrilotripropionic acid, cyclohexanediaminetetraacetic acid, 1,3-diamino-2-propanoltetraacetic acid, methyliminodiacetic acid, iminodiacetic acid, hydroxyiminodiacetic acid, dihydroxyethylglycine ethyl ether diaminetetraacetic acid, glycol ether diaminetetraacetic acid, ethylenediaminetetrapropionic acid, ethylenediaminedipropionic acid, phenylenediaminetetraacetic acid, 2-phosphonobutane-1,2,4-triacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, 1-hydroxyethylidene-1,1'-diphosphonic acid, etc.

of these compounds, complex salts of iron (III) with ethylenediaminetetraacetic acid, diethylenetriaminepentaacetic acid, cyclohexanediaminetetraacetic acid, 1,2-diaminopropanetetraacetic acid and methyliminodiacetic acid are preferred because of their high bleaching power.

The iron (III) complex salt may be a ready-made complex salt, or may be prepared in situ by reacting an iron (III) salt (e.g., ferric sulfate, ferric chloride, ferric nitrate, ammonium ferric sulfate, ferric phosphate, etc.) with a chelating agent (e.g., aminopolycarboxylic acids, aminopolyphosphonic acids, phosphonocarboxylic acids, etc.) in a solution. In the latter case, the ferric salt and/or chelating agent may be used in a combination of two or more thereof. In either the case of using a ready-made complex salt or in situ formation of a complex salt, the chelating agent may be used in an amount more than stoichiometric. The bleaching bath or blix bath containing the above-described ferric ion complex may further contain a metal ion other than iron (e.g., calcium, magnesium, aluminum, nickel, bismuth, zinc, tungsten, cobalt, copper, etc.) or a complex salt thereof or hydrogen peroxide.

The persulfate which can be used for bleaching or blixing includes alkali metal persulfates, such as potassium persulfate, sodium persulfate, etc., and ammonium persulfate.

The bleach bath or blix bath can contain a rehalogenating agent, such as a bromide (e.g., potassium bromide, sodium bromide, ammonium bromide, etc.), a chloride (e.g., potassium chloride, sodium chloride, ammonium chloride, etc.) or an iodide (e.g., ammonium iodide, etc.). If desired, the bleach bath or blix bath may further contain one or more of inorganic acids, organic acids, and alkali metal or ammonium salts thereof having a pH-buffering ability (e.g., boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc.) and a corrosion inhibitor, such as ammonium nitrate, guanidine, etc.

The bleaching agent is suitably used in an amount of from 0.1 to 2 mols per liter of a bleaching bath. The bleaching bath preferably has a pH ranging from 0.5 to 8.0 in case of using ferric ion complex salts as a bleaching agent, and particularly, ranging from 4.0 to 7.0 in the case of using a ferric ion complex salt formed by an aminopolycarboxylic acid, an aminopolyphosphonic acid, a phosphonocarboxylic acid or an organic phosphonic acid. If in using persulfates as a bleaching agent, a preferred concentration of the persulfate is from 0.1 to 2 mols per liter, and a preferred pH range is from 1 to 5.

A fixing agent to be used for fixing or blix is a known water-soluble dissolving agent for silver halides, such as thiosulfates, e.g., sodium thiosulfate, ammonium thiosulfate, etc.; thiocyanates, e.g., sodium thiocyanate, ammonium thiocyanate, etc.; thioether compounds, e.g., ethylenebisthioglycolic acid, 3,6-dithia-1,8-octanediol, etc.; thioureas; and the like. These compounds may be used either individually or in combinations of two or more thereof. Further, a specific blix bath comprising a combination of a fixing agent and a large quantity of a halide, e.g., potassium iodide, as described in Japanese Patent Application (OPI) No. 155354/80 can be used for blix processing.

The fixing agent concentration of the fixing or blix bath preferably ranges from 0.2 to 4 mols per liter. The blix bath preferably contains from 0.1 to 2 mols of a ferric ion complex salt and from 0.2 to 4 mols of a fixing agent per liter. The fixing or blix bath usually has a pH of from 4.0 to 9.0, and preferably from 5.0 to 8.0.

The fixing or blix bath can contain, in addition to the above-described additives, a preservative, such as a sulfite (e.g., sodium sulfite, potassium sulfite, ammonium sulfite, etc.), bisulfite, a hydroxylamine, a hydrazine, a bisulfite adduct of an aldehyde compound (e.g., acetaldehyde-sodium bisulfite, etc.), and the like. The fixing or blix bath can further contain various fluorescent brighening agents, defoaming agents, surface active agents, or organic solvents, e.g., polyvinyl pyrrolidone, methanol, etc.

The bleaching bath, blix bath or a prebath thereof, can contain a bleach accelerator, if desired. Specific examples of useful bleach accelerators are mercapto- or disulfide-containing compounds as described in U.S. Pat. No. 3,893,858, West German Patents 1,290,812 and 2,059,988, Japanese Patent Application (OPI) Nos. 32736/78, 57831/78, 37418/78, 65732/78, 72623/78, 95630/78, 95631/78, 95630/78, 95631/78, 104232/78, 12442478, 141623/78, and 28426/78, *Research Disclosure,* RD No. 17129 (July, 1978); thiazolidine derivatives as described in Japanese Patent Application (OPI) No. 140129/75; thiourea derivatives as described in Japanese Patent Publication No. 8506/70, Japanese Patent Application (OPI) Nos. 20832/77 and 32735/78 and U.S. Pat. No. 3,706,561; iodides as described in West German Pat. No. 1,127,715 and Japanese Patent Application (OPI) No. 16235/83; polyethylene oxides as described in West German Pat. Nos. 966,410 and 2,748,430; polyamine compounds as described in Japanese Patent Publication No. 8836/70; the compounds disclosed in Japanese Patent Application (OPI) Nos. 42434/74, 59644/74, 94927/78, 35727/79, 26506/80, 163940/83; and iodide or bromide ions. The preferred among them are compounds having a mercapto group or a disulfide group in view of their high accelerator activity. In particular, the compounds described in U.S. Pat. No. 3,893,858, West German Pat. No. 1,290,812 and Japanese Patent Application (OPI) No. 95630/78 are preferred. In addition, the compounds of U.S. Pat. No. 4,552,834 are also preferred. These bleach accelerators may be incorporated in light-sensitive materials.

When the above-described processing steps are performed continuously, a uniform quality can be assured by preventing variation of the composition of each processing solution.

If desired, each of the preceding baths can be equipped with a heater, a temperature sensor, a liquid level sensor, a circulatory pump, a filter, various kinds of floating lids, various kinds of squeegees, and the like.

The blix processing is generally applied to color papers, and, if desired, to color photographic light-sensitive materials for taking photographs.

The present invention is applicable to processing of color negative films, color reversal films, color positive films, color papers, and color reversal papers. In particular, the present invention is preferably applicable to color light-sensitive materials for taking photographs including color negative films.

The invention is now illustrated in greater detail with reference to the following examples, but it should be understood that they are not intended to limit the present invention.

EXAMPLE 1

A cellulose triacetate film support having been subjected to subbing treatment was coated with the following 1st to 14th layers to prepare a multi-layer color light-sensitive material.

| | |
|---|---|
| 1st Layer (Antihalation Layer): | |
| Black colloidal silver | 0.4 g-Ag/m$^2$ |
| Gelatin | 1.3 g/m$^2$ |
| Colored Coupler C-1 | 0.06 g/m$^2$ |
| Ultraviolet Absorbent UV-1 | 0.1 g/m$^2$ |
| Ultraviolet Absorbent UV-2 | 0.2 g/m$^2$ |
| Dispersing Oil-1 | 0.01 g/m$^2$ |
| Dispersing Oil-2 | 0.01 g/m$^2$ |
| 2nd Layer (Intermediate Layer): | |
| Fine silver bromide grains (mean grain size: 0.7 μm) | 0.15 g-Ag/m$^2$ |
| Gelatin | 1.0 g/m$^2$ |
| Colored Coupler C-2 | 0.02 g/m$^2$ |
| Dispersing Oil-1 | 0.1 g/m$^2$ |
| 3rd Layer (First Red-Sensitive Emulsion Layer): | |
| Silver iodobromide emulsion (silver iodide content: 6 mol %; diameter/thickness ratio: 2.5; mean grain size: 0.3 μm) | 1.5 g-Ag/m$^2$ |
| Gelatin | 0.6 g/m$^2$ |
| Sensitizing Dye I | $1.0 \times 10^{-4}$ mol/mol-AgX (X: halogen) |
| Sensitizing Dye II | $3.0 \times 10^{-4}$ mol/mol-AgX |
| Sensitizing Dye III | $1 \times 10^{-5}$ mol/mol-AgX |
| Coupler C-3 | 0.06 g/m$^2$ |
| Coupler C-4 | 0.06 g/m$^2$ |
| Coupler C-8 | 0.04 g/m$^2$ |
| Coupler C-2 | 0.03 g/m$^2$ |
| Dispersing Oil-1 | 0.03 g/m$^2$ |
| Dispersing Oil-3 | 0.012 g/m$^2$ |
| 4th Layer (Second Red-Sensitive Emulsion Layer): | |
| Silver iodobromide emulsion (silver iodide content: 6 mol %; diameter/thickness ratio: 3.5; mean grain | 1.5 g-Ag/m$^2$ |

-continued

| | |
|---|---|
| size: 0.5 μm) | |
| Sensitizing Dye I | $1.0 \times 10^{-4}$ mol/mol-AgX |
| Sensitizing Dye II | $3.0 \times 10^{-4}$ mol/mol-AgX |
| Sensitizing Dye III | $1 \times 10^{-5}$ mol/mol-AgX |
| Coupler C-3 | 0.24 g/m$^2$ |
| Coupler C-4 | 0.24 g/m$^2$ |
| Coupler C-8 | 0.04 g/m$^2$ |
| Coupler C-2 | 0.04 g/m$^2$ |
| Dispersing Oil-1 | 0.15 g/m$^2$ |
| Dispersing Oil-3 | 0.02 g/m$^2$ |
| 5th Layer (Third Red-Sensitive Emulsion Layer): | |
| Silver iodobromide emulsion (silver iodide content: 10 mol %; diameter/thickness ratio: 1.5; mean grain size: 0.7 μm) | 2.0 g-Ag/m$^2$ |
| Gelatin | 1.0 g/m$^2$ |
| Sensitizing Dye I | $1.0 \times 10^{-4}$ mol/mol-AgX |
| Sensitizing Dye II | $3.0 \times 10^{-4}$ mol/mol-AgX |
| Sensitizing Dye III | $1 \times 10^{-5}$ mol/mol-AgX |
| Coupler C-6 | 0.05 g/m$^2$ |
| Coupler C-7 | 0.1 g/m$^2$ |
| Dispersing Oil-1 | 0.01 g/m$^2$ |
| Dispersing Oil-2 | 0.05 g/m$^2$ |
| 6th Layer (Intermediate Layer): | |
| Gelatin | 1.0 g/m$^2$ |
| Compound A | 0.03 g/m$^2$ |
| Dispersing Oil-1 | 0.05 g/m$^2$ |
| 7th Layer (First Green-Sensitive Emulsion Layer): | |
| Silver iodobromide emulsion (silver iodide content: 6 mol %; diameter/thickness ratio: 2.5; mean grain size: 0.3 μm) | 0.7 g-Ag/m$^2$ |
| Sensitizing Dye IV | $5 \times 10^{-4}$ mol/mol-AgX |
| Sensitizing Dye VI | $0.3 \times 10^{-4}$ mol/mol-AgX |
| Sensitizing Dye V | $2 \times 10^{-5}$ mol/mol-AgX |
| Gelatin | 1.0 g/m$^2$ |
| Coupler C-9 | 0.2 g/m$^2$ |
| Coupler C-5 | 0.03 g/m$^2$ |
| Coupler C-1 | 0.03 g/m$^2$ |
| Dispersing Oil-1 | 0.5 g/m$^2$ |
| 8th Layer (Second Green-Sensitive Emulsion Layer): | |
| Silver iodobromide emulsion (silver iodide content: 5 mol %; diameter/thickness ratio: 3.5; mean grain size: 0.5 μm) | 1.4 g-Ag/m$^2$ |
| Sensitizing Dye IV | $5 \times 10^{-4}$ mol/mol-AgX |
| Sensitizing Dye V | $2 \times 10^{-4}$ mol/mol-AgX |
| Sensitizing Dye VI | $0.3 \times 10^{-5}$ mol/mol-AgX |
| Coupler C-9 | 0.25 g/m$^2$ |
| Coupler C-1 | 0.03 g/m$^2$ |
| Coupler C-10 | 0.015 g/m$^2$ |
| Coupler C-5 | 0.01 g/m$^2$ |
| Dispersing Oil-1 | 0.2 g/m$^2$ |
| 9th Layer (Third Green-Sensitive Emulsion Layer): | |
| Silver iodobromide emulsion (silver iodide content: 10 mol %; diameter/thickness ratio: 1.5; mean grain size: 0.7 μm) | 1.9 g-Ag/m$^2$ |

-continued

| | |
|---|---|
| Gelatin | 1.0 g/m$^2$ |
| Sensitizing Dye VII | $3.5 \times 10^{-4}$ mol/mol-AgX |
| Sensitizing Dye VIII | $1.4 \times 10^{-4}$ mol/mol-AgX |
| Coupler C-11 | 0.01 g/m$^2$ |
| Coupler C-12 | 0.03 g/m$^2$ |
| Coupler C-13 | 0.20 g/m$^2$ |
| Coupler C-1 | 0.02 g/m$^2$ |
| Coupler C-15 | 0.02 g/m$^2$ |
| Dispersing Oil-1 | 0.20 g/m$^2$ |
| Dispersing Oil-2 | 0.05 g/m$^2$ |
| 10th Layer (Yellow Filter Layer): | |
| Gelatin | 1.2 g/m$^2$ |
| Yellow colloidal silver | 0.16 g-Ag/m$^2$ |
| Compound B | 0.1 g/m$^2$ |
| Dispersing Oil-1 | 0.3 g/m$^2$ |
| 11th Layer (First Blue-Sensitive Emulsion Layer): | |
| Mono-dispersed silver iodobromide emulsion (silver iodide content: 6 mol %; diameter/thickness ratio: 1.5; mean grain size: 0.3 μm) | 1.0 g-Ag/m$^2$ |
| Gelatin | 1.0 g/m$^2$ |
| Sensitizing Dye IX | $2 \times 10^{-4}$ mol/mol-AgX |
| Coupler C-14 | 0.9 g/m$^2$ |
| Coupler C-5 | 0.07 g/m$^2$ |
| Dispersing Oil-1 | 0.2 g/m$^2$ |
| 12th Layer (Second Blue-Sensitive Emulsion Layer): | |
| Silver iodobromide emulsion (silver iodide content: 10 mol %; diameter/thickness ratio: 1.5; mean grain size: 1.5 μm) | 0.9 g-Ag/m$^2$ |
| Gelatin | 0.6 g/m$^2$ |
| Sensitizing Dye IX | $1 \times 10^{-4}$ mol/mol-AgX |
| Coupler C-14 | 0.25 g/m$^2$ |
| Dispersing Oil-1 | 0.07 g/m$^2$ |
| 13th Layer (First Protective Layer): | |
| Gelatin | 0.8 g/m$^2$ |
| Ultraviolet Absorbent UV-1 | 0.1 g/m$^2$ |
| Ultraviolet Absorbent UV-2 | 0.2 g/m$^2$ |
| Dispersing Oil-1 | 0.01 g/m$^2$ |
| Dispersing Oil-2 | 0.01 g/m$^2$ |
| 14th Layer (Second Protective Layer): | |
| Fine silver bromide grains (mean grain size: 0.07 μm) | 0.5 g-Ag/m$^2$ |
| Gelatin | 0.45 g/m$^2$ |
| Polymethyl methacrylate particles (diameter: 1.5 μm) | 0.2 g/m$^2$ |
| Hardening Agent H-1 | 0.4 g/m$^2$ |
| Formaldehyde Scavenger S-1 | 0.5 g/m$^2$ |
| Formaldehyde Scavenger S-2 | 0.5 g/m$^2$ |

In addition to the above-described components, each layer further contained a surface active agent as a coating aid. The thus prepared sample was designated as Sample 101.

Compounds used in the preparation of Sample 101 were as follows:

UV-1

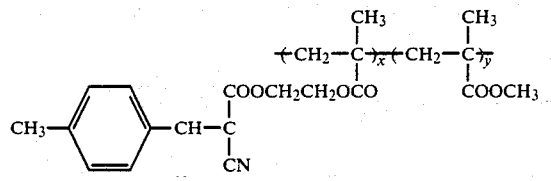

x/y = 7/3 (by weight)

UV-2

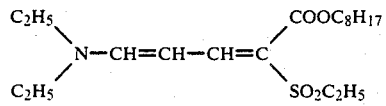

Oil-1: Tricresyl phosphate
Oil-2: Dibutyl phthalate
Oil-3: Bis(2-ethylhexyl) phthalate -continued
C-1
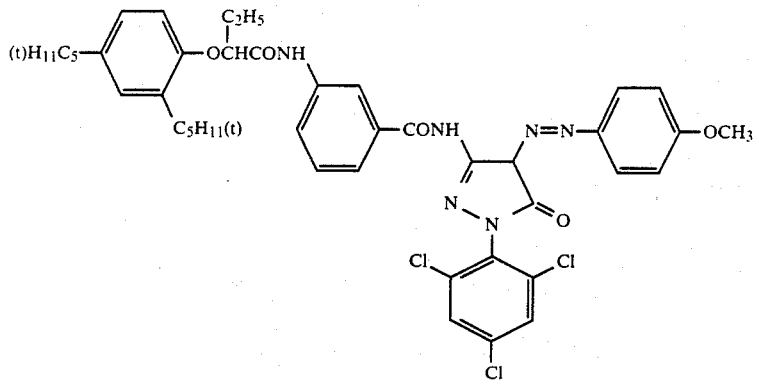
C-2
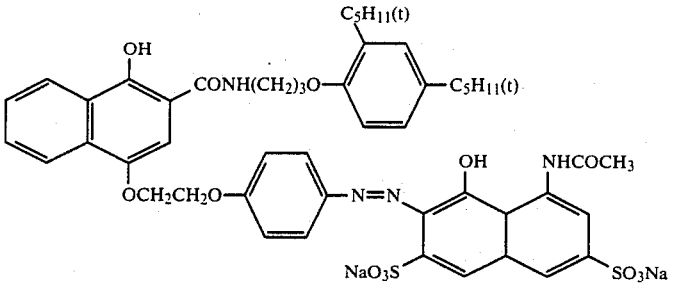
C-3
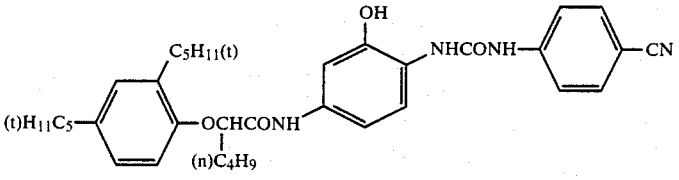
C-4
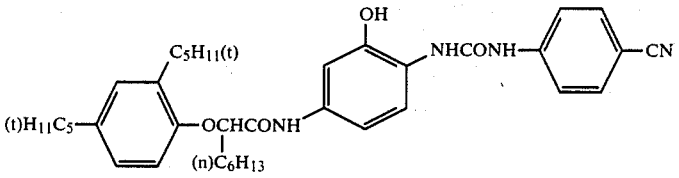
C-5
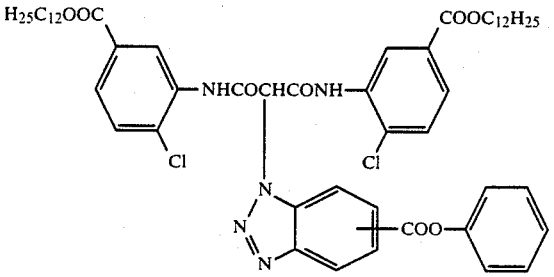

-continued
C-6
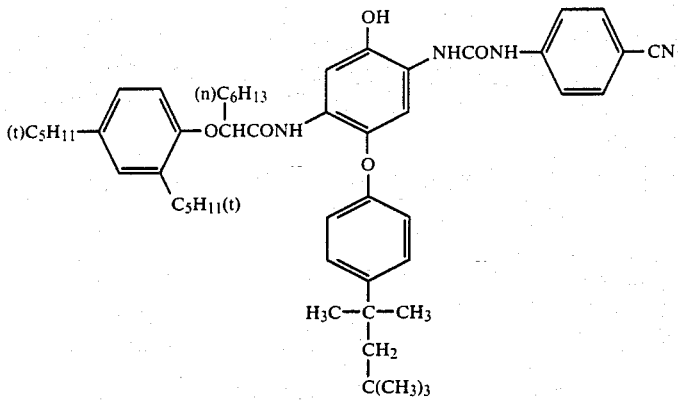
C-7
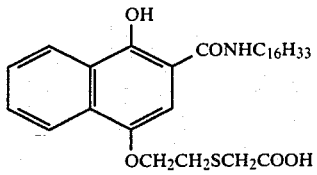
C-8
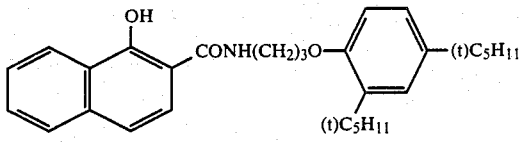
C-9
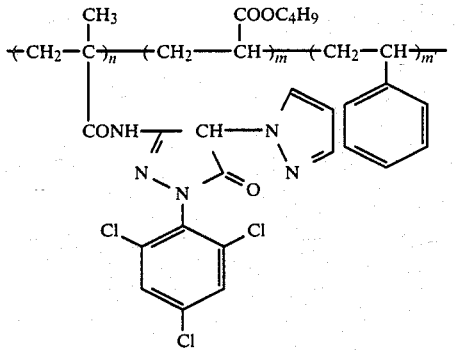
n = 50
m = 25 m' = 25
Molecular Weight: about 20,000
C-10
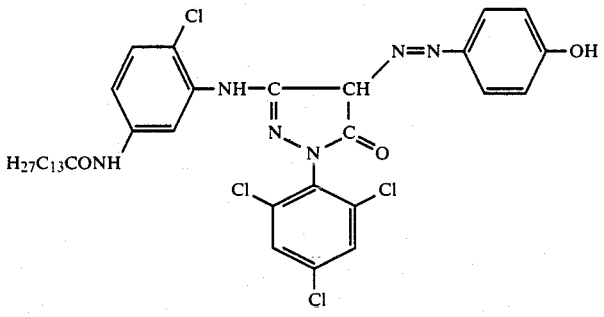

-continued
C-11
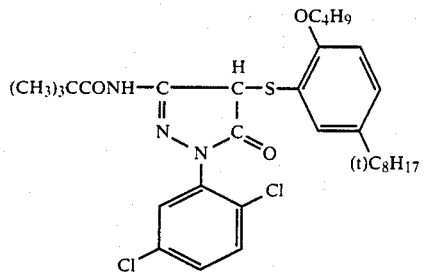
C-12
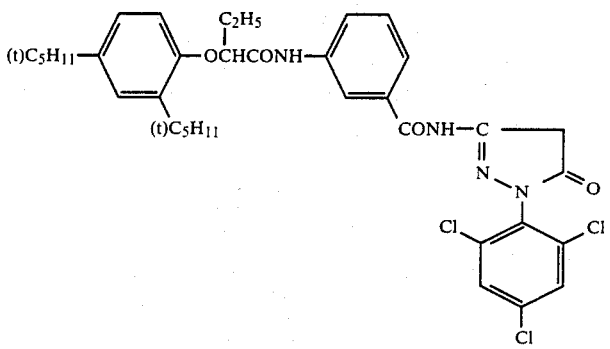
C-13
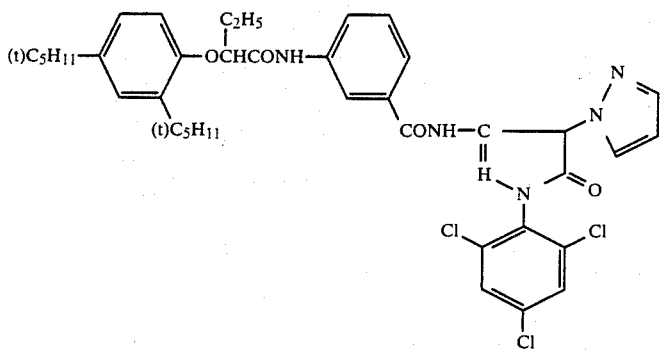
C-14
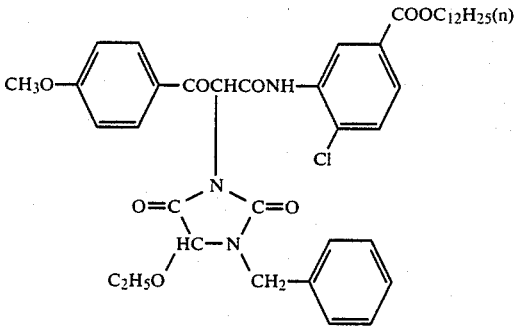
C-15
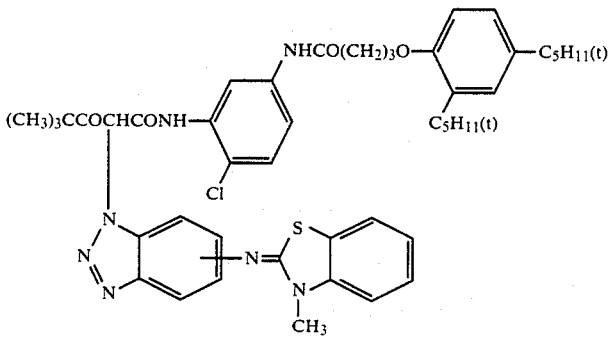

-continued
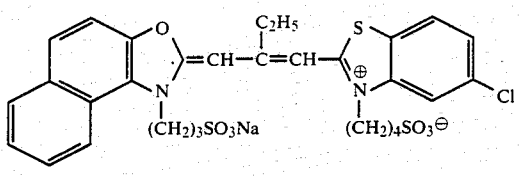
Sensitizing Dye I
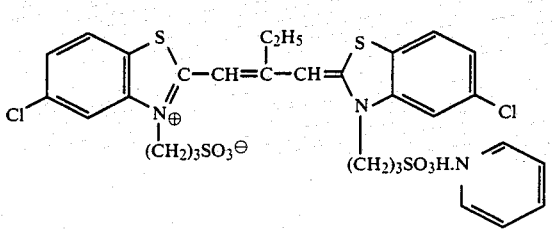
Sensitizing Dye II
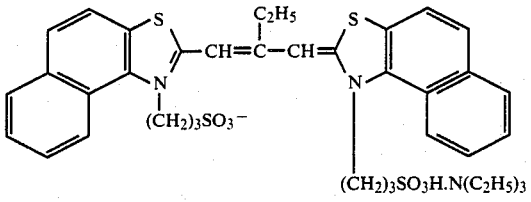
Sensitizing Dye III
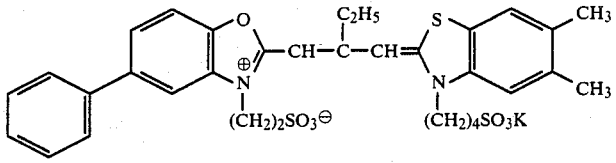
Sensitizing Dye VI
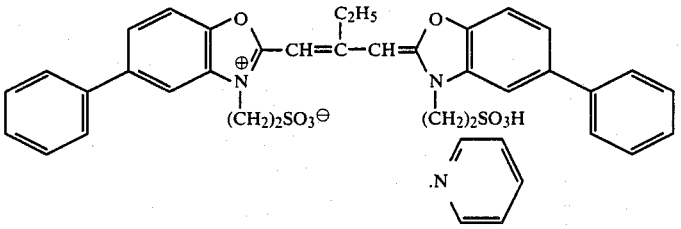
Sensitizing Dye VII
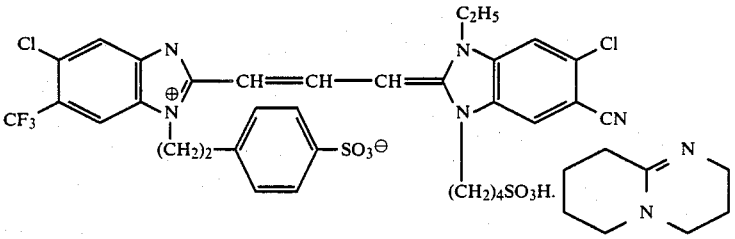
Sensitizing Dye VIII
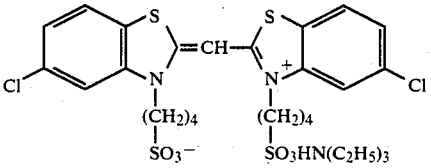
Sensitizing Dye IX
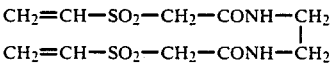
H-1

-continued

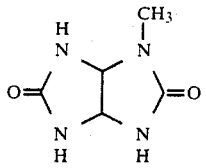

S-2

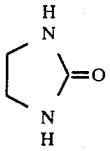

S-2

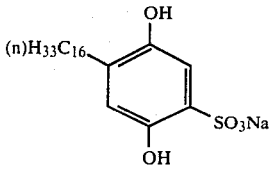

Compound A

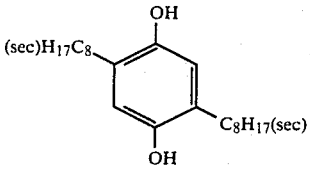

Compound B

Sample 102 was prepared in the same manner as for sample 101, except that the first layer further contained $2.5\times10^{-4}$ mol/m$^2$ of Compound (I) of the present invention.

Sample 103 was prepared in the same manner as for Sample 101, except that the first layer further contained $2.5\times10^{-4}$ mol/m$^2$ of Compound (9) of the present invention.

Of the resulting multilayer color light-sensitive materials, Sample 101 was cut to a width of 35 mm. Photographs of a standard object were taken outdoors using the strip film, and the film was subjected to processing according to Table 1 using an automatic developing machine.

TABLE 1

| Processing (Temp.: 38° C.) | | | |
|---|---|---|---|
| Step | Time | Tank Capacity (l) | Amount of Replenisher* (ml) |
| Color Development | 3'15" | 8 | 38 |
| Bleach | 4'20" | 8 | 18 |
| Fixation | 3'15" | 8 | 33 |
| Washing (1) | 1'30" | 4 | — |
| Washing (2) | 1'30" | 4 | see Table 2 |
| Stabilization | 1'05" | 4 | 33 |

*Per meter of the strip of 35 mm in width

In the washing step of Table 1 above, water was caused to flow countercurrently from (2) towards (1). Formulations of each processing solution used were as follows:

| | Fresh Tank Solution (g) | Replenisher (g) |
|---|---|---|
| Color developing Solution | | |
| Diethylenetriaminepentaacetic acid | 1.0 | 1.1 |
| 1-Hydroxyethylidene-1,1-diphosphonic acid | 2.0 | 2.2 |
| Sodium sulfite | 4.0 | 4.4 |
| Potassium carbonate | 30.0 | 32.0 |
| Potassium bromide | 1.4 | 0.7 |
| Potassium iodide | 1.3 mg | — |
| Hydroxylamine | 2.4 | 2.6 |
| 4-(N—Ethyl-N—β-hydroxylethyl-amino)-2-methylaniline sulfate | 4.5 | 5.0 |
| Water to make | 1 liter | 1 liter |
| pH | 10.00 | 10.05 |
| Bleaching Solution: | | |
| Ammonium (ethylenediamine-tetraacetato)ferrite | 100 | 110 |
| Disodium ethylenediamine-tetraacetate | 10 | 11 |
| Aqueous ammonia | 7 ml | 5 ml |
| Ammonium nitrate | 10.0 | 12.0 |
| Ammonium bromide | 150 | 170 |
| Water to make | 1 liter | 1 liter |
| pH | 6.0 | 5.8 |
| Fixing Solution | | |
| Disodium ethylenediamine-tetraacetate | 1.0 | 1.2 |
| Sodium sulfite | 4.0 | 5.0 |
| Sodium bisulfite | 4.6 | 5.8 |
| Ammonium thiosulfate aqueous solution (70 wt %) | 175 ml | 200 ml |
| Water to make | 1 liter | 1 liter |
| pH | 6.6 | 6.6 |
| Stabilizing Solution: | | |
| Formalin (37 wt % formaldehyde Solution) | 2.0 ml | 3.0 ml |
| Polyoxyethylene-p-monononyl-phenyl ether (average degree of polymerization: 10) | 0.3 | 0.45 |
| Water to make | 1 liter | 1 liter |
| Washing Water and Replenisher for Washing: | | |
| Tap water | | |

The conditions for continuous washing processing (hereinafter referred to as running) by the automatic developing machine were as shown in Table 2 below.

TABLE 2

| Running No. | Amount of Carried-Over Preceding Bath (A)*1 (ml) | Amount of Replenishing Water (B)*2 (ml) | (B)/(A) | Amount of Film Processed (ml) |
|---|---|---|---|---|
| 1 | 2 | 1000*3 | 500 | 8 |
| 2 | 2 | 100 | 50 | 80 |
| 3 | 2 | 30 | 15 | 270 |
| 4 | 2 | 10 | 5 | 800 |

Note:
*1The sample of 1 m length was taken out immediately before entering into the washing bath, immediately followed by extracting with 1 liter of distilled water by stirring with a magnetic stirrer for 10 minutes while keeping at 30° C. After masking sulfite ions in the extract by adding formaldehyde, the thiosulfate ion concentration of the extract ($C_1$; g/l) was determined by acidic iodimetry. The thiosulfate ion concentration in the preceding fixing bath ($C_2$; g/l) was also determined in the same manner. The amount (A; ml) was calculated by the following equation:

$$C_1 \times \frac{(1000 + A)}{A} = C_2$$

TABLE 2-continued

| Running No. | Amount of Carried-Over Preceding Bath (A)*1 (ml) | Amount of Replenishing Water (B)*2 (ml) | (B)/(A) | Amount of Film Processed (ml) |
|---|---|---|---|---|

*2Per meter of the film.
*3Approximate to the standard amount of water used when no saving of water is effected.

After completion of each running, the compounds shown in Table 3 were successively added to the washing bath or stabilizing bath. Each of Sample Nos. 101 to 103 having been wedgewise exposed to light at 4800° K. and 20 CMS was processed in the same manner as described above, except for using every washing bath or stabilizing bath containing the additive or additives of Table 3.

TABLE 3

| Running No. | Test No. | (B)/(A) | Sample No. | Additive to Washing Bath | Additive to Stabilizing Bath | Remark |
|---|---|---|---|---|---|---|
| 1 | 1 | 500 | 101 | — | — | Comparison |
| " | 2 | " | 102 | — | — | " |
| " | 3 | " | 103 | — | — | " |
| " | 4 | " | 101 | — | 27 wt % aqueous ammonia (1 g) | " |
| 2 | 5 | 50 | 101 | — | — | " |
| " | 6 | " | 102 | — | — | Invention |
| " | 7 | " | 103 | — | — | " |
| " | 8 | " | 101 | — | 27 wt % aqueous ammonia (0.5 g) | Comparison |
| " | 9 | " | 101 | — | 27 wt % aqueous ammonium (4 g) | " |
| 3 | 10 | 15 | 101 | — | — | " |
| " | 11 | " | 102 | — | — | Invention |
| " | 12 | " | 103 | — | — | " |
| " | 13 | " | 101 | Compound A-1 ($3 \times 10^{-4}$ mol/liter) | — | Comparison |
| " | 14 | " | 102 | Compound A-1 ($3 \times 10^{-4}$ mol/liter) | — | Invention |
| " | 15 | " | 103 | Compound A-1 ($3 \times 10^{-4}$ mol/liter) | — | " |
| " | 16 | " | 101 | Compound A-1 ($1 \times 10^{-3}$ mol/liter) | — | Comparison |
| " | 17 | " | 102 | Compound A-1 ($1 \times 10^{-3}$ mol/liter) | — | Invention |
| " | 18 | " | 103 | Compound A-1 ($1 \times 10^{-3}$ mol/liter) | — | " |
| " | 19 | 15 | 101 | Compound A-1 ($1 \times 10^{-3}$ mol/liter) Compound (9) ($2 \times 10^{-3}$ mol/liter) | — | Invention |
| 4 | 20 | 5 | 101 | — | — | Comparison |
| " | 21 | " | 102 | — | — | Invention |
| " | 22 | " | 103 | — | — | " |
| " | 23 | " | 101 | Compound (1) ($1 \times 10^{-3}$ mol/liter) | | |
| " | 24 | " | 102 | Compound (1) ($1 \times 10^{-3}$ mol/liter) | — | " |
| " | 25 | " | 103 | Compound (1) ($1 \times 10^{-3}$ mol/liter) | — | " |
| " | 26 | " | 101 | Compound A-1 ($1 \times 10^{-3}$ mol/liter) Compound (1) ($2 \times 10^{-3}$ mol/liter) | — | " |

In Table 3 above, the additives for washing baths were added to both the first and the second tanks in the same concentrations. In Test Nos. 13 to 19 and 26, the pH of the washing bath was adjusted with sodium hydroxide so as to be equal to that before addition of Compound A-1. In Test Nos. 4, 8, and 9, the stabilizing bath was adjusted to a pH of 7.0 with hydrochloric acid after the addition of aqueous ammonia. The addition of ammonia to stabilizing baths for comparison was intended to show the effect of an ammonia-releasing compound as described in Japanese Patent Application (OPI) No. 135942/85.

The thus processed samples were evaluated for growth of mold and the occurrence stains and discoloration of the cyan dye in accordance with the following methods. The results obtained are shown in Table 4.

Method of Evaluation

Growth of Mold:

*Aspergillus niger, Penicillium citrinum* and *ketronium A glucas* were suspended in a nutrient medium, M-40Y, at a one-tenth concentration, and 0.03 ml of the suspension was pipetted on the center of the emulsion layer side of the sample cut into a size of 35 mm×40 mm to form a spot of about 2 mm in diameter. The sample was placed on absorbent cotton impregnated with sterilized water as a moisture source in a sterilized plastic-made petri dish and preserved at 27° C. for 3 weeks with a cover on the dish. The mold growth area extending in a circular form was grated in average diameter as follows:

1. Average diameter exceeded 2 cm.
2. Average diameter was less than 2 cm
3. Average diameter was less than 1 cm
4. No extension from the pipetted spot was observed.

Stain:

The minimum magenta density of the sample was determined, and a difference from that of Sample 101 in Test No. 1 was obtained.

Discoloration:

The sample was preserved in a thermostat at 80° C. for 3 weeks with uncontrolled humidity (about 10 to 30%), and discoloration (a decrease in density) of the area having an initial cyan density of 1.5 was determined.

TABLE 4

| Test No. | Sample No. | Mold | Stain | Cyan Discoloration | Remark |
|---|---|---|---|---|---|
| 1 | 101 | 2 | 0 | −0.13 | Comparison |
| 2 | 102 | 2 | 0 | −0.13 | " |
| 3 | 103 | 2 | 0 | −0.13 | " |
| 4 | 101 | 2 | 0 | −0.20 | " |
| 5 | 101 | 1 | +0.03 | −0.14 | " |
| 6 | 102 | 3 | 0 | −0.13 | Invention |
| 7 | 103 | 3 | 0 | −0.13 | " |
| 8 | 101 | 1 | +0.03 | −0.22 | Comparison |
| 9 | 101 | 1 | +0.03 | −0.30 | " |
| 10 | 101 | 1 | +0.05 | −0.14 | " |
| 11 | 102 | 3 | 0 | −0.13 | Invention |
| 12 | 103 | 3 | +0.01 | −0.13 | " |
| 13 | 101 | 1 | +0.05 | −0.13 | Comparison |
| 14 | 102 | 3 | 0 | −0.14 | Invention |
| 15 | 103 | 3 | 0 | −0.14 | " |
| 16 | 101 | 1 | +0.05 | −0.11 | Comparison |
| 17 | 102 | 4 | 0 | −0.10 | Invention |
| 18 | 103 | 4 | 0 | −0.10 | " |
| 19 | 101 | 4 | +0.03 | −0.11 | " |
| 20 | 101 | 1 | +0.10 | −0.16 | Comparison |
| 21 | 102 | 3 | +0.02 | −0.16 | Invention |
| 22 | 103 | 2 | +0.02 | −0.15 | " |
| 23 | 101 | 3 | +0.04 | −0.15 | " |
| 24 | 102 | 3 | +0.02 | −0.15 | " |
| 25 | 103 | 3 | +0.02 | −0.15 | " |
| 26 | 101 | 4 | +0.03 | −0.13 | |

As can be seen from Table 4, a saving of washing water causes increases in mold growth and stains (magenta), while in the present invention the growth of mold can be suppressed sufficiently even when the amount of washing water is greatly reduced, producing rather better results than in the case of using a large quantity of water. Further, an increase of magenta stains due to reduction of washing water can be markedly inhibited by the present invention. It is also found that the method of this invention does not cause an increase in discoloration of the cyan dye.

EXAMPLE 2

Sample 104 was prepared in the same manner as described in Example 1, except for the following changes in kind or amount of couplers, diameter/thickness ratio of emulsion grains and amount of sensitizing dyes.

3rd Layer (First Red-Sensitive Emulsion Layer):

Coupler C-4 was replaced by the same mols of Coupler C-18.

5th Layer (Third Red-Sensitive Emulsion Layer):

The diameter/thickness ratio was changed to 7.5, and the amounts of Sensitizing Dyes I, II and III were doubled.

7th Layer (First Green-Sensitive Emulsion Layer):

The amount of Coupler C-9 was decreased by half, and 0.7 g/m$^2$ of Coupler C-16 was additionally used.

9th Layer (Third Green-Sensitive Emulsion Layer):

The diameter/thickness ratio was changed to 6.5, and the amounts of Sensitizing Dyes VII and VIII were increased 1.6 times.

11th Layer (First Blue-Sensitive Emulsion Layer):

The amount of Coupler C-14 was decreased by half, and 0.8 g/m$^2$ of Coupler C-17 was additionally used. The diameter/thickness ratio was changed to 15, and the amount of Sensitizing Dye IX was increased 3 times.

12th Layer (Second Blue-Sensitive Emulsion Layer):

The diameter/thickness ratio was changed to 20, and the amount of Sensitizing Dye IX was increased 3.5 times.

The compounds used in Sample 104, other than those described in Example 1, were as follows:

C-16

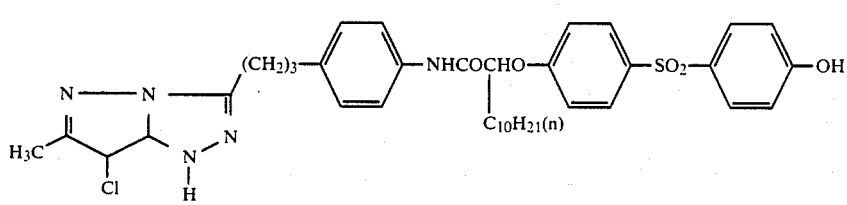

-continued

C-17

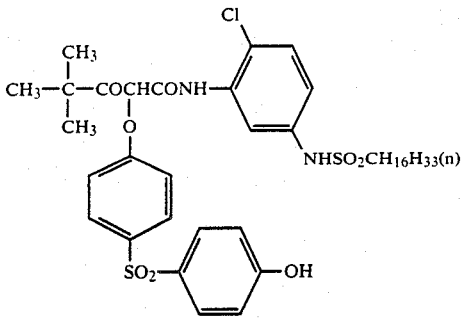

C-18

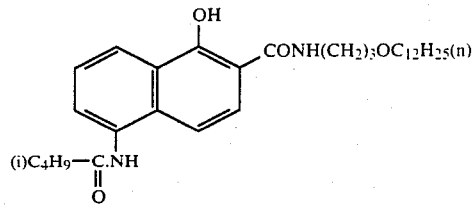

Sample 105 was prepared in the same manner as for Sample 104, except that the 6th layer additionally contained Compound (1) of the invention in an amount of $2.5\times10^{-4}$ mol per $m^2$.

Of the resulting samples, Sample 104 was cut in a width of 35 mm. After taking photographs of a standard outdoor scene, the film was subjected to development processing according to Table 5 below by means of an automatic developing machine.

TABLE 5

| Step | Processing (Temp.: 38° C.) Time | Tank Capacity (l) | Amount of Replenisher* (ml) |
|---|---|---|---|
| Color Development | 3'15" | 10 | 38 |
| Bleach | 1'00" | 4 | 18 |
| Blix | 3'15" | 10 | 27 |
| Washing (1) | 40" | 4 | — |
| Washing (2) | 1'00" | 4 | 27 |
| Stabilization | | 4 | 18 |

*Per meter of the strip of 35 mm in width

In the washing step of Table 5, water was caused to flow countercurrently from (2) to (1). The overflow accompanied by replenishing of the bleaching bath was introduced into the blix bath.

The processing solutions used in the development processing had the following formulations:

Color Developing Solution:

Both the fresh tank solution and replenisher had the same formulations as used in Example 1.

Bleaching Solution:

The formulation was common to both the running solution and replenisher:

| | |
|---|---|
| Ammonium bromide | 100 g |
| Ammonium (ethylenediaminetetraacetato)ferrite | 120 g |
| Disodium ethylenediaminetetraacetate | 10.0 g |
| Ammonium nitrate | 10.0 g |
| Bleach accelerator of formula: | |
| $H_3C(CH_3)N-(CH_2)_2-S-S-(CH_2)_2-N(CH_3)CH_3$ | |
| Aqueous ammonia | 17.0 ml |
| Water to make | 1 liter |
| pH | 6.5 |

Blix Solution:

| | Fresh Tank Solution (g) | Replenisher (g) |
|---|---|---|
| Ammonium bromide | 50.0 | — |
| Ammonium (ethylenediamine-tetraacetato)ferrite | 50.0 | — |
| Disodium ethylenediamine-tetraacetate | 5.0 | 1.0 |
| Ammonium nitrate | 5.0 | — |
| Bleach accelerator of the same formula as above | 1.0 | — |
| Sodium sulfite | 12.0 | 20.0 |
| Ammonium thiosulfate aqueous solution (70 wt %) | 240 ml | 400 ml |
| Aqueous ammonia | 10.0 ml | — |
| Water to make | 1 liter | 1 liter |
| pH | 7.3 | 8.0 |

Stabilizing Solution

Both the fresh tank solution and replenisher had the same formulations as in Example 1.

Washing Water and Replenisher for Washing:

Tap water

The amount of the preceding bath carried over into the washing bath was calculated in the same manner as in Example 1, and found to be 2 ml per meter. Accordingly, the ratio (B)/(A) as defined in Example 1 was 13.5.

After 300 m of the strip film of Sample 104 was processed, each of Samples 104 and 105 having been wedgewise exposed to light under the same conditions as in Example 1 was processed in the same manner as described above. Then, $2\times10^{-3}$ mol/liter of Compound (7) of the present invention was added to the washing bath, and processing of each of Samples 104 and 105 was repeated.

The thus processed samples were evaluated for prevention of mold growth in the same manner as described in Example 1. The results obtained are shown in Table 6.

TABLE 6

| Test No. | Sample No. | Additive to Washing Bath | Mold | Remark |
|---|---|---|---|---|
| 27 | 104 | none | 1 | Comparison |
| 28 | 105 | none | 3 | Invention |
| 29 | 104 | Compound (7) ($2\times10^{-3}$ mol/liter) | 3 | " |
| 30 | 105 | Compound (7) ($2\times10^{-3}$ mol/liter) | 3 | " |

It can be seen from Table 6 above that the processing method of the present invention makes it possible to save washing water while sufficiently inhibiting the growth of mold.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photographic material, wherein a washing bath is replenished with water in an amount of from 2 to 50 times the volume of the preceding bath which is carried over with the photographic material into the washing bath per unit area of the photographic material to be processed, and washing in the washing bath is carried out in the presence of at least one compound represented by formula (I):

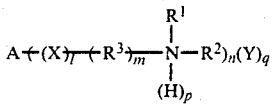

(I)

wherein A represents an n-valent aliphatic, aromatic or heterocyclic linking group, wherein n is 1, A represents a monovalent aliphatic, aromatic or heterocyclic group, or a hydrogen atom; X represents —O—, —S—, or

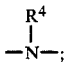

$R^1$ and $R^2$ each represents a substituted or unsubstituted lower alkyl group; $R^3$ represents a lower alkylene group; $R^4$ represents a lower alkyl group; or $R^1$ and $R^2$, $R^1$ and A, $R^1$ and $R^3$, $R^2$ and A, or $R^2$ and $R^3$ may be connected to each other to form a ring; Y represents an anion; l represents 0 or 1; m represents 0 or 1; n represents 1, 2, or 3; p represents 0 or 1; and q represents 0, 1, 2, or 3, and is a value which renders the molecule electrically neutral, wherein at least the final tank of the tanks constituting the washing bath contains from $5\times10^{-4}$ to $1\times10^{-2}$ mol/liter of at least one compound selected from aminocarboxylic acids, aminophosphonic acids, phosphonic acids, phosphonocarboxylic acids, and salts thereof.

2. A method as in claim 1, wherein said compound of formula (I) is present in at least one of the photographic material and the washing bath.

3. A method as in claim 2, wherein said compound of formula (I) is present in the photographic material in an amount of from $1\times10^{-5}$ to $1\times10^{-2}$ mol/m$^2$.

4. A method as in claim 3, wherein said compound of formula (I) is present in the photographic material in an amount of from $2\times10^{-5}$ to $5\times10^{-3}$ mol/m$^2$.

5. A method as in claim 2, wherein said compound of formula (I) is present in the washing bath in an amount of from $1\times10^{-5}$ to $10^{-1}$ mol/liter.

6. A method as in claim 5, wherein said compound of formula (I) is present in the washing bath in an amount of from $1\times10^{-4}$ to $5\times10^{-2}$ mol/liter.

7. A method as in claim 1, wherein the amount of the replenishing water per unit area of the photographic material is from 3 to 50 times the volume of the preceding bath which is carried over into the washing bath.

8. A method as in claim 7, wherein the amount of the replenishing water per unit area of the photographic material is from 5 to 30 times the volume of the preceding bath which is carried over into the washing bath.

9. A method as in claim 3, wherein the amount of the replenishing water per unit area of the photographic material is from 3 to 50 times the volume of the preceding bath which is carried over into the washing bath.

10. A method as in claim 5, wherein the amount of the replenishing water per unit area of the photographic material is from 3 to 50 times the volume of the preceding bath which is carried over into the washing bath.

11. A method as in claim 4, wherein the amount of the replenishing water per unit area of the photographic material is from 5 to 30 times the volume of the preceding bath which is carried over into the washing bath.

12. A method as in claim 6, wherein the amount of the replenishing water per unit area of the photographic material is from 5 to 30 times the volume of the preceding bath which is carried over into the washing bath.

13. A method as in claim 10, wherein at least the final tank of the tanks constituting the washing bath contains from $5\times10^{-4}$ to $1\times10^{-2}$ mol/liter of at least one compound selected from aminocarboxylic acids, aminophosphonic acids, phosphonic acids, phosponocarboxylic acids, and salts thereof.

14. A method as in claim 10, wherein at least the final tank of the tanks constituting the washing bath contains from $5\times10^{-4}$ to $1\times10^{-2}$ mol/liter of at least one compound selected from aminocarboxylic acids, aminophosphonic acids, phosphonic acids, phosponocarboxylic acids, and salts thereof.

15. A method as in claim 1, wherein said acids and salts are aminocarboxylic acids or salts thereof.

16. A method as in claim 15, wherein said salts are sodium salts or potassium salts.

* * * * *